US009355828B1

(12) United States Patent
Smith et al.

(10) Patent No.: US 9,355,828 B1
(45) Date of Patent: May 31, 2016

(54) RECORDING SPATIAL AND TEMPORAL PROPERTIES OF IONS EMITTED FROM A QUADRUPOLE MASS FILTER

(71) Applicant: Thermo Finnigan LLC, San Jose, CA (US)

(72) Inventors: Johnathan Wayne Smith, San Jose, CA (US); Alan E. Schoen, San Jose, CA (US)

(73) Assignee: THERMO FINNIGAN LLC, San Jose, CA (US)

( * ) Notice: Subject to any disclaimer, the term of this patent is extended or adjusted under 35 U.S.C. 154(b) by 0 days.

(21) Appl. No.: 14/561,166

(22) Filed: Dec. 4, 2014

(51) Int. Cl.
*H01J 49/02* (2006.01)
*H01J 49/42* (2006.01)

(52) U.S. Cl.
CPC ..... *H01J 49/025* (2013.01); *H01J 49/4215* (2013.01); *H01J 2237/24435* (2013.01)

(58) Field of Classification Search
CPC ..... H01J 49/025; H01J 49/4215; H01J 2237/24435; H01J 37/244
See application file for complete search history.

(56) References Cited

U.S. PATENT DOCUMENTS

| | | | | |
|---|---|---|---|---|
| 5,644,128 | A * | 7/1997 | Wollnik | H01J 49/025 250/251 |
| 6,345,139 | B1 | 2/2002 | Fuse et al. | |
| 6,950,573 | B2 | 9/2005 | Ota et al. | |
| 7,339,521 | B2 * | 3/2008 | Scheidemann | H01J 49/107 342/179 |
| 7,351,955 | B2 | 4/2008 | Kovtoun | |
| 7,928,382 | B2 * | 4/2011 | Hatakeyama | H01J 37/244 250/306 |
| 8,389,929 | B2 | 3/2013 | Schoen et al. | |
| 9,214,322 | B2 * | 12/2015 | Kholomeev | H01J 49/025 |
| 2002/0014839 | A1 * | 2/2002 | Jagutzki | H01J 49/025 313/540 |
| 2007/0030483 | A1 | 2/2007 | Everett et al. | |
| 2009/0261243 | A1 * | 10/2009 | Bamberger | H01J 49/025 250/287 |
| 2010/0074063 | A1 | 3/2010 | Peng et al. | |
| 2011/0095177 | A1 * | 4/2011 | Giannakopulos | H01J 49/025 250/282 |
| 2011/0095178 | A1 * | 4/2011 | Giannakopulos | H01J 49/025 250/287 |
| 2013/0175443 | A1 * | 7/2013 | Schoen | H01J 49/025 250/288 |
| 2014/0246579 | A1 * | 9/2014 | Hoyes | H01J 49/025 250/282 |
| 2015/0034819 | A1 * | 2/2015 | Hoyes | H01J 49/025 250/282 |

OTHER PUBLICATIONS

U.S. Appl. No. 14/561,158, Non-Final Rejection mailed Oct. 26, 2015, pp. 1-11.

Giffin et al., "An Electro-Optical Detector for Focal Plane Mass Spectrometers," International Journal of Mass Spectrometry and Ion Physics, 1974, 15, pp. 437-449.

Hill et al., "A variable dispersion array detector for a tandem mass spectrometer," International Journal of Mass Spectrometry and Ion Processes, 1991, 111, pp. 1-25.

* cited by examiner

*Primary Examiner* — Wyatt Stoffa
(74) *Attorney, Agent, or Firm* — Thomas F. Cooney; Nicholas Cairns; Michael C. Staggs

(57) ABSTRACT

An ion detection system for a detecting a quantity of ions exiting from a mass analyzer of a mass spectrometer comprises: (a) photon generating means configured to receive the quantity of ions and to generate a quantity of photons that is proportional to the quantity of ions; (b) a light collection lens optically coupled to the photon generating means and configured to transmit a beam of the generated photons; (c) line focusing means operable to focus at least a first portion of the beam to a line; and (d) a linear array of photo-detectors configured to detect a variation of the quantity of generated photons along the focused line.

33 Claims, 14 Drawing Sheets

RECORDING SPATIAL AND TEMPORAL PROPERTIES OF IONS EMITTED FROM A QUADRUPOLE MASS FILTER

FIELD OF THE INVENTION

The present invention relates to the field of mass spectrometry. More particularly, the present invention relates to a mass spectrometer system and method in which ions exiting a mass analyzer are converted to a quantity of photons that are focused to a line and a variation of the quantity and position of photons is measured parallel to the focused line.

BACKGROUND OF THE INVENTION

Typically, a multipole mass filter (e.g., a quadrupole mass filter) may be used for mass analysis of ions provided within a continuous ion beam. A quadrupole field is produced within the quadrupole apparatus by dynamically applying electrical potentials on configured parallel rods arranged with four-fold symmetry about a long axis, which comprises an axis of symmetry that is conventionally referred to as the z-axis. By convention, the four rods are described as a pair of "x-rods" and a pair of "y-rods". At any instant of time, the two x-rods have the same potential as each other, as do the two y-rods. The potential on the y-rods is inverted with respect to the x-rods. The "x-direction" or "x-dimension" is taken along a line connecting the centers of the x-rods. The "y-direction" or "y-dimension" is taken along a line connecting the centers of the y-rods.

Relative to the constant potential along the z-axis, the potential on each set of rods can be expressed as a constant DC offset plus an RF component that oscillates rapidly (with a typical frequency of about 1 MHz). The DC offset on the x-rods is positive so that a positive ion feels a restoring force that tends to keep it near the z-axis; the potential in the x-direction is like a well. Conversely, the DC offset on the y-rods is negative so that a positive ion feels a repulsive force that drives it further away from the z-axis; consequently, the potential in the x,y-plane is in the form of a saddle.

An oscillatory RF component is applied to both pairs of rods. The RF phase on the x-rods is the same and differs by 180 degrees from the phase on the y-rods. Ions move inertially along the z-axis from the entrance of the quadrupole to a detector often placed at the exit of the quadrupole. Inside the quadrupole, ions have trajectories that are separable in the x and y directions. In the x-direction, the applied RF field carries ions with the smallest mass-to-charge ratios out of the potential well and into the rods. Ions with sufficiently high mass-to-charge ratios remain trapped in the well and have stable trajectories in the x-direction; the applied field in the x-direction acts as a high-pass mass filter. Conversely, in the y-direction, only the lightest ions are stabilized by the applied RF field, which overcomes the tendency of the applied DC to pull them into the rods. Thus, the applied field in the y-direction acts as a low-pass mass filter. Ions that have both stable component trajectories in both x- and y-directions pass through the quadrupole to reach the detector.

In operation, the DC offset and RF amplitude applied to a quadrupole mass filter is chosen so as to transmit only ions within a restricted range of mass-to-charge (m/z) ratios through the entire length of the quadrupole. Such apparatuses can be operated either in the radio frequency (RF)-only mode or in an RF/DC mode. Depending upon the particular applied RF and DC potentials, only ions of selected m/z ratios are allowed to pass completely through the rod structures, whereas the remaining ions follow unstable trajectories leading to escape from the applied multipole field. When only an RF voltage is applied between predetermined electrodes, the apparatus serves to transmit ions in a wide-open fashion above some threshold mass. When a combination of RF and DC voltages is applied between predetermined rod pairs there is both an upper cutoff mass as well as a lower cutoff mass, such that only a restricted range of m/z ratios (i.e., a pass band) passes completely through the apparatus. As the ratio of DC to RF voltage increases, the transmission band of ion masses narrows so as to provide for mass filter operation, as known and as understood by those skilled in the art. As is further known, the amplitudes of the DC and RF voltages may be simultaneously varied, but with the DC/RF ratio held nearly constant but varied to maintain a uniform pass band, such that the pass band is caused to systematically "scan" a range of m/z ratios. Detection of the quantity of ions passed through the quadrupole mass filter over the course of such scanning enables generation of a mass spectrum.

Typically, such quadrupole mass filters are employed as a component of a triple stage mass spectrometer system. By way of non-limiting example, FIG. 1A schematically illustrates a triple-quadrupole system, as generally designated by the reference numeral 1. The operation of mass spectrometer 1 can be controlled and data 68 can be acquired by a control and data system (not depicted) of various circuitry of one or more known types, which may be implemented as any one or a combination of general or special-purpose processors (digital signal processor (DSP)), firmware, software to provide instrument control and data analysis for mass spectrometers and/or related instruments. A sample containing one or more analytes of interest can be ionized via an ion source 52 operating at or near atmospheric pressure. The resultant ions are directed via predetermined ion optics that often can include tube lenses, skimmers, and multipoles, e.g., reference characters 53 and 54, so as to be urged through a series of chambers, e.g., chambers 2, 3 and 4, of progressively reduced pressure that operationally guide and focus such ions to provide good transmission efficiencies. The various chambers communicate with corresponding ports 80 (represented as arrows in FIG. 1A) that are coupled to a set of vacuum pumps (not shown) to maintain the pressures at the desired values.

The example mass spectrometer system 1 of FIG. 1A is shown illustrated to include a triple stage configuration 64 within a high vacuum chamber 5, the triple stage configuration having sections labeled Q1, Q2 and Q3 electrically coupled to respective power supplies (not shown). The Q1, Q2 and Q3 stages may be operated, respectively, as a first quadrupole mass filter, a fragmentation cell, and a second quadrupole mass filter. Ions that are either filtered, filtered and fragmented or fragmented and filtered within one or more of the stages are passed to a detector 66. Such a detector is beneficially placed at the channel exit of the quadrupole (e.g., Q3 of FIG. 1A) to provide data that can be processed into a rich mass spectrum (data) 68 showing the variation of ion abundance with respect to m/z ratio.

During conventional operation of a multipole mass filter, such as the quadrupole mass filter Q3 shown in FIG. 1A, to generate a mass spectrum, a detector (e.g., the detector 66 of FIG. 1A) is used to measure the quantity of ions that pass completely through the mass filter as a function of time while the RF and DC voltage amplitudes are scanned. Thus, at any point in time, the detector only receives those ions having m/z ratios within the mass filter pass band at that time—that is, only those ions having stable trajectories within the multipole under the particular RF and DC voltages that are applied at that time. Such conventional operation creates a trade-off between instrument resolution (or instrument speed) and sensitivity. High mass resolving can be achieved, but only if the DC/RF ratio is such that the filter pass band is very narrow, such that most ions develop unstable trajectories within the mass filter and few pass through to the detector. Under such conditions, scans must be performed relatively slowly so as to detect an adequate number of ions at each m/z data point. Conversely, high sensitivity or high speed can also be achieved during conventional operation, but only by widening the pass band, thus causing degradation of m/z resolution.

U.S. Pat. No. 8,389,929, which is assigned to the assignee of the present invention and which is incorporated by reference herein in its entirety, teaches a quadrupole mass filter method and system that discriminates among ion species, even when both are simultaneously stable, by recording where the ions strike a position-sensitive detector as a function of the applied RF and DC fields. When the arrival times and positions are binned, the data can be thought of as a series of ion images. Each observed ion image is essentially the superposition of component images, one for each distinct m/z value exiting the quadrupole at a given time instant. The same patent also teaches methods for the prediction of an arbitrary ion image as a function of m/z and the applied field. Thus, each individual component image can be extracted from a sequence of observed ion images by mathematical deconvolution or decomposition processes, as further discussed in the patent. The mass-to-charge ratio and abundance of each species necessarily follow directly from the deconvolution or decomposition.

The inventors of U.S. Pat. No. 8,389,929 recognized that ions of different m/z ratios exiting a quadrupole mass filter may be discriminated, even when both ions are simultaneously stable (that is, have stable trajectories) within the mass filter by recording where the ions strike a position-sensitive detector as a function of the applied RF and DC fields. The inventors of U.S. Pat. No. 8,389,929 recognized that such operation is advantageous because when a quadrupole is operated in, for example, a mass filter mode, the scanning of the device that is provided by ramped RF and DC voltages naturally varies the spatial characteristics with time as observed at the exit aperture of the instrument. Specifically, ions manipulated by a quadrupole are induced to perform a complex 2-dimensional oscillatory motion on the detector cross section as the scan passes through the stability region of the ions. All ion species of respective m/z ratios express exactly the same motion, at the same Mathieu parameter "a" and "q" values, but at different respective RF and DC voltages and at different respective times. The ion motion (i.e., for a cloud of ions of the same m/z but with various initial displacements and velocities) may be characterized by the variation of a and q, this variation influencing the position and shape cloud of ions exiting the quadrupole as a function of time. For two masses that are almost identical, the sequence of their respective oscillatory motions is essentially the same and can be approximately related by a time shift.

The aforementioned U.S. Pat. No. 8,389,929 teaches, inter alia, a mass spectrometer instrument having both high mass resolving power and high sensitivity, the mass spectrometer instrument including: a multipole configured to pass an abundance of one or more ion species within stability boundaries defined by applied RF and DC fields; a detector configured to record the spatial and temporal properties of the abundance of ions at a cross-sectional area of the multipole; and a processing means. The data acquired by the so-configured detector can be thought of as a series of ion images. Each observed ion image is essentially the superposition of component images, one for each distinct m/z value exiting the quadrupole at a given time instant. The aforementioned patent also provides for the prediction of an arbitrary ion image as a function of m/z and the applied field. As a result, each individual component can be extracted from a sequence of observed ion images by mathematical deconvolution or decomposition processes which generate the mass-to-charge ratio and abundance of each species. Accordingly, high mass resolving power may be achieved under a wide variety of operating conditions, a property not usually associated with quadrupole mass spectrometers.

The teachings of the aforementioned U.S. Pat. No. 8,389,929 exploit the varying spatial characteristics by collecting the spatially dispersed ions of different m/z even as they exit the quadrupole at essentially the same time. FIG. 1B shows a simulated recorded image of a particular pattern at a particular instant in time. The example image can be collected by a fast detector, (i.e., a detector capable of time resolution of 10 or more RF cycles, more often down to an RF cycle or with sub RF cycles specificity, where said sub-RF specificity is possibly averaged for multiple RF cycles), positioned to acquire where and when ions exit and with substantial mass resolving power to distinguish fine detail. When an ion, at its (q, a) position, enters the stability region during a scan, the y-component of its trajectory changes from "unstable" to "stable". Watching an ion image formed in the exit cross section progress in time, the ion cloud is elongated and undergoes wild vertical oscillations that carry it beyond the top and bottom of a collected image. Gradually, the exit cloud contracts, and the amplitude of the y-component oscillations decreases. If the cloud is sufficiently compact upon entering the quadrupole, the entire cloud remains in the image, i.e. 100% transmission efficiency, during the complete oscillation cycle when the ion is well within the stability region.

As the ion approaches the exit of the stability region, a similar effect happens, but in reverse and involving the x-component rather than the y-component. The cloud gradually elongates in the horizontal direction and the oscillations in this direction increase in magnitude until the cloud is carried across the left and right boundaries of the image. Eventually, both the oscillations and the length of the cloud increase until the transmission decreases to zero.

FIG. 1B graphically illustrates such a result. In particular, the vertical cloud of ions, as enclosed graphically by the ellipse 6 shown in FIG. 1B, correspond to the heavier ions entering the stability diagram, as described above, and accordingly oscillate with an amplitude that brings such heavy ions close to the denoted y-quadrupoles. The cluster of ions enclosed graphically by the ellipse 8 shown in FIG. 1B correspond to lighter ions exiting the stability diagram and thus cause such ions to oscillate with an amplitude that brings such lighter ions close to the denoted x-quadrupoles. Within the image lie the additional clusters of ions (shown in FIG. 1B but not specifically highlighted) that have been collected at the same time frame but which have a different exit pattern because of the differences of their a and q parameters.

FIG. 1C illustrates one example of a time and position ion detector system, generally designated by the reference numeral 20 as described in the aforementioned U.S. Pat. No. 8,389,929. As shown in FIG. 1C, incoming ions I (shown directionally by way of accompanying arrows) having for example a beam cross section of about 1 mm or less, varying to the quadrupole's inscribed radius as they exit from an ion occupation volume between quadrupole rod electrodes 101, are received by an assembly of microchannel plates (MCPs) 13. Such an assembly can include a pair of MCPs (a Chevron or V-stack) or triple (Z-stack) comprising MCPs adjacent to one another with each individual plate having sufficient gain and resolution to enable operating at appropriate bandwidth requirements (e.g., at about 1 MHz up to about 100 MHz) with the combination of plates generating up to about $10^7$ electrons in response to each incident ion.

To illustrate operability by way of an example, the first surface of the MCP assembly 13 can be floated to 10 kV, (i.e., +10 kV when configured for negative ions and −10 kV when configured to receive positive ions), with the second surface floated to +12 kV and −8 kV respectively, as shown in FIG. 1C. Such a plate biasing provides for a 2 kV voltage gradient to provide the gain with a resultant output relative 8 to 12 kV relative to ground. All high voltages portions are under vacuum between about $10^{15}$ mBar ($10^{13}$ Pa) and $10^{-6}$ mBar ($10^{-4}$ Pa).

The example biasing arrangement of FIG. 1C thus enables impinging ions I as received from, for example, the exit of a quadrupole, as discussed above, to induce electrons in the front surface of the MCP 13 for the case of positive ions, that are thereafter directed to travel along individual channels of the MCP 13 as accelerated by the applied voltages. As known to those skilled in the art, since each channel of the MCP serves as an independent electron multiplier, the input ions I as received on the channel walls produce secondary electrons (denoted as $e^-$). This process is repeated hundreds of times by the potential gradient across both ends of the MCP stack 13 and a large number of electrons are in this way released from the output end of the MCP stack 13 to substantially enable the preservation of the pattern (image) of the particles incident on the front surface of the MCP. When operated in negative ion mode, negative ions are initially converted to small positive ions that then induce a similar electron cascade as is well known in the art.

The biasing arrangement of the detector system 20 (FIG. 1C) also provides for the electrons multiplied by the MCP stack 13 to be further accelerated in order to strike an optical component, e.g., a phosphor coated fiber optic plate 15 configured behind the MCP stack 13. Such an arrangement converts the signal electrons to a plurality of resultant photons (denoted as p) that are proportional to the amount of received electrons. Alternatively, an optical component, such as, for example, an aluminized phosphor screen can be provided with a biasing arrangement (not shown) such that the resultant electron cloud from the MCP 13 stack can be drawn across a gap by the high voltage onto a phosphor screen where the kinetic energy of the electrons is released as light. The initial assembly is configured with the goal of converting either a positive or negative ion image emanating from the quadrupole exit into a photon image suitable for acquisition by subsequent photon imaging technology.

The photons p emitted by the phosphor coated fiber optic plate or aluminized phosphor screen 15 are captured and then converted to electrons which are then translated into a digital signal by a two-dimensional camera component 25 (FIG. 1C). In the illustrated arrangement, a plate, such as, a photosensitive channel plate 10 assembly (shown with the anode output biased relative to ground) can convert each incoming photon p back into a photoelectron. Each photoelectron generates a cloud of secondary electrons 11 (indicated as $e^-$) at the back of the photosensitive channel plate 10, which spreads and impacts as one arrangement, an array of detection anodes 12, such as, but not limited to, an two-dimensional array of resistive structures, a two-dimensional delay line wedge and strip design, as well as a commercial or custom delay-line anode readout. As part of the design, the photosensitive channel plate 10 and the anodes 12 are in a sealed vacuum enclosure (not shown).

Each of the anodes of the two-dimensional camera 25 shown in FIG. 1C can be coupled to an independent amplifier 14 and additional analog to digital circuitry (ADC) 18 as known in the art. For example, such independent amplification can be by way of differential transimpedance amplifiers to amplify and suppress noise and transform detected current into voltage. The signals resultant from amplifiers 14 and analog to digital circuitry (ADC) 18 and/or charge integrators (not shown) can eventually be directed to a Field Programmable Gate Array (FPGA) 22 via, for example, a serial LVDS (low-voltage differential signaling) high-speed digital interface 21, which is a component designed for low power consumption and high noise immunity for the anticipated data rates. The FPGA 21, when electrically coupled to a computer or other data processing means 26, may be operated as an application-specific hardware accelerator for the required computationally intensive tasks.

The time and position mass spectrometer ion detector systems taught in the aforementioned U.S. Pat. No. 8,389,929, as exemplified by the accompanying FIG. 1C, provide an important advancement in the field of multipole mass spectrometers. However, the inventors of the present application have realized that certain modifications to the previously taught detection system are beneficial and can improve usefulness and operational flexibility under various circumstances. For example, the two-dimensional camera systems taught in U.S. Pat. No. 8,389,929 provide a large quantity of useful ion spatial distribution data which can be utilized for accurate calculation of ion species abundances. However, processing of such large quantities of data on the required RF-level time scale requires special computational electronics which gives rise to extra complexity and cost. Further, the two-dimensional imaging detection system, when implemented as described in U.S. Pat. No. 8,389,929, completely replaces a conventional electron multiplier detector system. However, it may be desirable, under various circumstances, to retain a portion of the functionality or configuration of traditional dynode-based mass spectrometer detector systems for the purposes of: (a) comparison with conventional or existing mass spectrometer data or (b) pulse-count detection of very weak signals and (c) providing an ion time and position system as a retrofit enhancement to an existing mass spectrometer.

SUMMARY

In order to implement the above-described desirable improvements, the inventors of the present application have recognized that the full two-dimensional imaging capability described in U.S. Pat. No. 8,389,929 is unnecessary for adequate data processing. Thus, in one instance, the previously described two-dimensional array of light-sensitive pixels may be simply replaced by two one-dimensional pixel arrays—each such one-dimensional array possibly comprising a linear photo-detector array, such as a line camera, and oriented so as to detect a distribution pattern of ions exiting a quadrupole device in a respective one of the x- and y-dimensions. Since the ion motion of interest is orthogonal in the x- and y-dimensions, most information can be retained by simply binning the original two-dimensional image into an x-array and a y-array as previously taught. Here, the binning is accomplished by optically compressing an original two dimensional distribution of phosphor-derived photons along the y-direction so as to be detected by individual photon detecting pixels of the x-array of and also optically compressing the distribution of photons along the x-direction so as to be detected by individual photon detecting pixels of the y-array. Optical compression is accomplished with the use of a novel 2-dimensional to 1-dimensional optical component developed by the inventors. Such an arrangement significantly reduces the number of pixels that must be electronically read.

The inventors of the present application have further recognized that, in many circumstances, a sufficient quantity of time and position data may be obtained by only employing a single one-dimensional photo detector array—either an x-array or a y-array—as described in the above paragraph. The elimination of one of the detector arrays enables the optional incorporation of an additional detector comprising either an electrometer to detect electrons generated from ions exiting a quadrupole or an additional photodetector, such as a photomultiplier tube or silicon photomultiplier, so as to detect photons generated from those electrons by phosphorescence. The additional detector provides additional conventional features, such as pulse counting.

According to a first aspect of the present teachings, an ion detection system for detecting a quantity of ions exiting from a mass analyzer of a mass spectrometer is provided, the ion detection system comprising: (a) photon generating means configured to receive the quantity of ions and to generate a quantity of photons that is proportional to the quantity of ions; (b) a light collection lens optically coupled to the photon generating means and configured to transmit a beam of the generated photons; (c) line focusing means operable to focus at least a first portion of the beam to a line; and (d) a linear array of photo-detectors configured to detect a variation of the quantity of generated photons along the focused line. The ions exiting from the mass analyzer may exit from a quadrupole apparatus.

The photon generation means may comprise: (a1) electron generating means configured to receive the quantity of ions and to generate a quantity of electrons that is proportional to the quantity of ions; and (a2) a phosphor screen disposed on a surface of a substrate and configured to receive the quantity of generated electrons and to generate the quantity of photons in proportion to the quantity of generated electrons. The electron generating means may comprise an assembly of microchannel plates (MCPs) or metal channel dynodes, the assembly comprising a first end facing the mass analyzer and a second end facing the phosphor screen; and an electrode disposed at the first end and an electrode disposed at the second end of the assembly.

In some embodiments the line focusing means comprises a cylindrical lens. In some embodiments, the line-focusing means comprises a beam compressor apparatus (I) a prismatic core section comprising a plurality of waveguide plates disposed in a stacked arrangement parallel to two prism basal faces; an entrance face that receives the generated photons; and an exit face from which the generated photons are emitted, the core section comprising a taper from the entrance to the exit face; and (II) a reflective coating disposed on at least one face of the prismatic core section other than the entrance and exit faces. The beam compressor apparatus may be optically coupled between a cylindrical lens of the line-focusing means and the linear array of photo-detectors. In some embodiments, the linear array of photo-detectors comprises a line camera.

In various embodiments, the ion detection system may include: (e) an additional photodetector optically coupled to the light collection lens so as to receive a second portion of the beam that is not focused by the line focusing means. Some of these embodiments may also include an optical beam splitter configured to receive the beam and to divide the beam into the first and second portions. Some embodiments having the additional photodetector may include a two-dimensional optical parabolic concentrator optically coupled between the light collection lens and the additional photodetector. The additional photodetector may comprise a photomultiplier tube or silicon photomultiplier. Alternatively, in those embodiments in which a beam splitter is present, the additional photodetector may comprise a second linear array of photo-detectors configured to detect a variation of the quantity of generated photons along the second focused line; and a second line focusing means operable to focus the second portion of the beam to a second line on the second linear array of photodetectors. The second line-focusing means may comprise a cylindrical lens, a beam compressor apparatus as described above or both a cylindrical lens and a beam compressor apparatus. In yet other alternative embodiments in which the photon generating means includes a phosphor screen disposed on a surface of a substrate and configured to receive the quantity of generated electrons, the additional photodetector may comprise an electrometer that is electrically coupled to an electrode in contact with substrate that collects the quantity of electrons. An electronic amplifier may be electrically coupled between the electrode and the electrometer.

According to a second aspect of the present teachings, A method of detecting a quantity of ions emitted from a mass analyzer of a mass spectrometer is disclosed, the method comprising: (i) generating a quantity of photons corresponding to the quantity of ions; (ii) focusing a light beam comprising at least a first portion of the quantity of photons to a focused line; and (iii) detecting a variation of the at least a first portion of the quantity of generated photons along the focused line using a linear array of photodetectors, wherein the variation of the quantity of generated photons along the focused line corresponds to a variation of the quantity of ions emitted from the mass analyzer parallel to a first cross-section direction of the mass analyzer.

In some embodiments, the method may further comprise (iv) detecting an intensity of a second portion of the quantity of generated photons using an additional photodetector. The additional photodetector may comprise a second linear array of photodetectors, in which case the second portion of the quantity of photons may be focused onto the second linear array of photodetectors as a second focused line, wherein a variation of the second portion of the quantity of generated photons along the second focused line corresponds to a variation of the quantity of ions emitted from the mass analyzer parallel to a second cross-section direction of the mass analyzer, the second cross-section direction being orthogonal to the first cross-section direction. In some embodiments, the first and second portions of the quantity of generated photons may be separated using a beam splitter. In various embodiments, the step (i) of generating the quantity of photons may comprise: generating a quantity of electrons corresponding to the quantity of ions; and generating the quantity of photons, wherein the generated quantity of photons corresponds to the generated quantity of electrons. In such embodiments, the quantity of generated electrons may be measured using an electrometer.

According to a third aspect of the present teachings, an ion detection system for a detecting a quantity of ions exiting from a mass analyzer of a mass spectrometer is provided, the ion detection system comprising: (a) an assembly of one or more microchannel plates disposed at an ion exit end of the mass analyzer, the assembly having a front end disposed so as to receive the quantity of ions and a back end; (b) a first and a second electrode disposed at the front and back ends, respectively, of the assembly of microchannel plates; (c) at least one voltage source electrically coupled to the first, second and third electrodes; (d) a substrate plate comprising a front face disposed facing the microchannel plate assembly and a back face and having a phosphorescent material disposed on the front face; (e) a third electrode disposed in contact with the front face of the substrate plate; (f) a light collection lens optically coupled to the back face of the substrate plate; (g) a line focusing means optically coupled to the light collection lens; and (h) a linear array of photo-detectors disposed at a focus of the line focusing means.

The system may further comprise an additional photodetector system optically coupled to the light collection lens. In some embodiments, the additional photodetector system comprises an additional linear array of photodetectors, and the system further comprises: an optical beam splitter optically coupled between the light collection lens and the line focusing means; and a two-dimensional optical parabolic concentrator optically coupled between the light collection lens and the additional linear array of photodetectors, wherein the additional linear array of photodetectors is disposed at a focus of the second line focusing means. In some embodiments, the additional photodetector system comprises a photomultiplier tube or silicon photomultiplier. In such embodiments, the system may further comprise: an optical beam splitter optically coupled between the light collection lens and the line focusing means; and a two-dimensional optical parabolic concentrator optically coupled between the optical beam splitter and the additional photodetector system. Some embodiments of the system may include: a fourth electrode disposed in contact with the front face of the substrate plate; and an electrometer electrically coupled to the fourth electrode.

Fresnel lenses may be employed in place of conventional smooth surface lenses in any of the disclosed embodiments. In such cases, most of the optics assembly is an arrangement of planer devices comprising Fresnel lenses and possibly mirrors or beam splitters. In the case of embodiments that employ a linear array of photodetectors, the linear array may be significantly longer than the original phosphor image, such as when the linear array comprises an array of discrete silicon photomultipliers. In such cases, it is generally desirable to compress the image in one dimension and enlarge it in the other. Such an image transfer scheme may be accomplished with a combination of mutually-orthogonally-disposed cylindrical lenses, disposed between the phosphor and the detector array. The long throw this optical arrangement requires may be folded using mirrors or prisms to reduce the overall optics footprint. In the embodiments that comprise a beam splitter to image the two dimensional image, these mirrors may be arranged to throw the two linear images onto the same plane thereby facilitating fabrication of the sensor arrays on a single printed circuit board (PCB) or on two small daughter PCBs attached to a carrier PCB. In the latter case, daughter boards are not necessarily co-planar but rather simply mounted to a single carrier board and the images may be perpendicular to that board.

BRIEF DESCRIPTION OF THE DRAWINGS

The above noted and various other aspects of the present invention will become further apparent from the following description which is given by way of example only and with reference to the accompanying drawings, not drawn to scale, in which.

DETAILED DESCRIPTION

The following description is presented to enable any person skilled in the art to make and use the invention, and is provided in the context of a particular application and its requirements. Various modifications to the described embodiments will be readily apparent to those skilled in the art and the generic principles herein may be applied to other embodiments. Thus, the present invention is not intended to be limited to the embodiments and examples shown but is to be accorded the widest possible scope in accordance with the features and principles shown and described. The particular features and advantages of the invention will become more apparent with reference to the appended FIGS. 2, 3A, 3B, 3C, 4A and 4B, taken in conjunction with the following description.

Figure 1C:
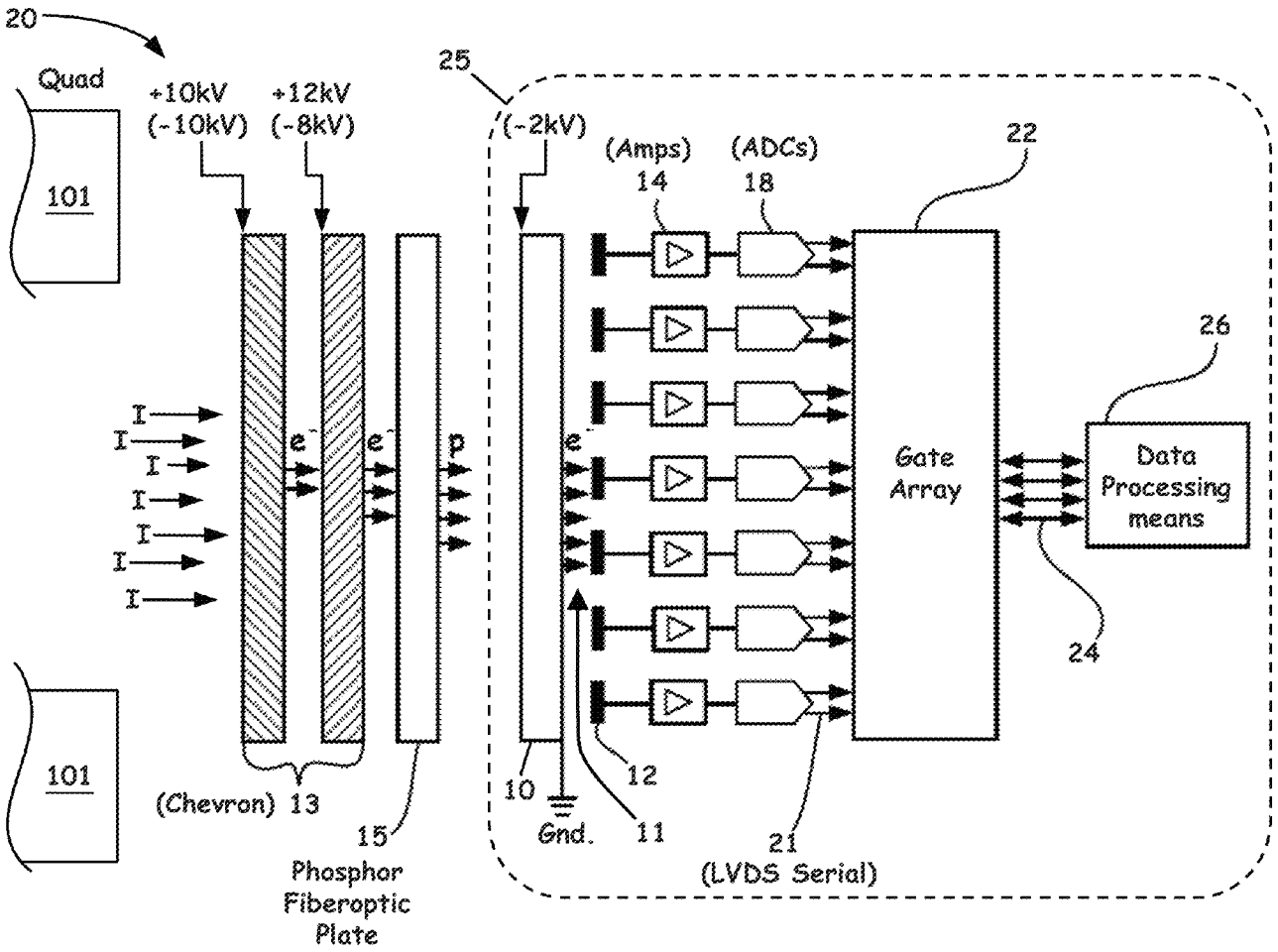
FIG. 1C (Prior Art)
FIG. 1C is an example embodiment of a time and position ion detector system configured with a linear array of read-out anodes.
Figure 2A:
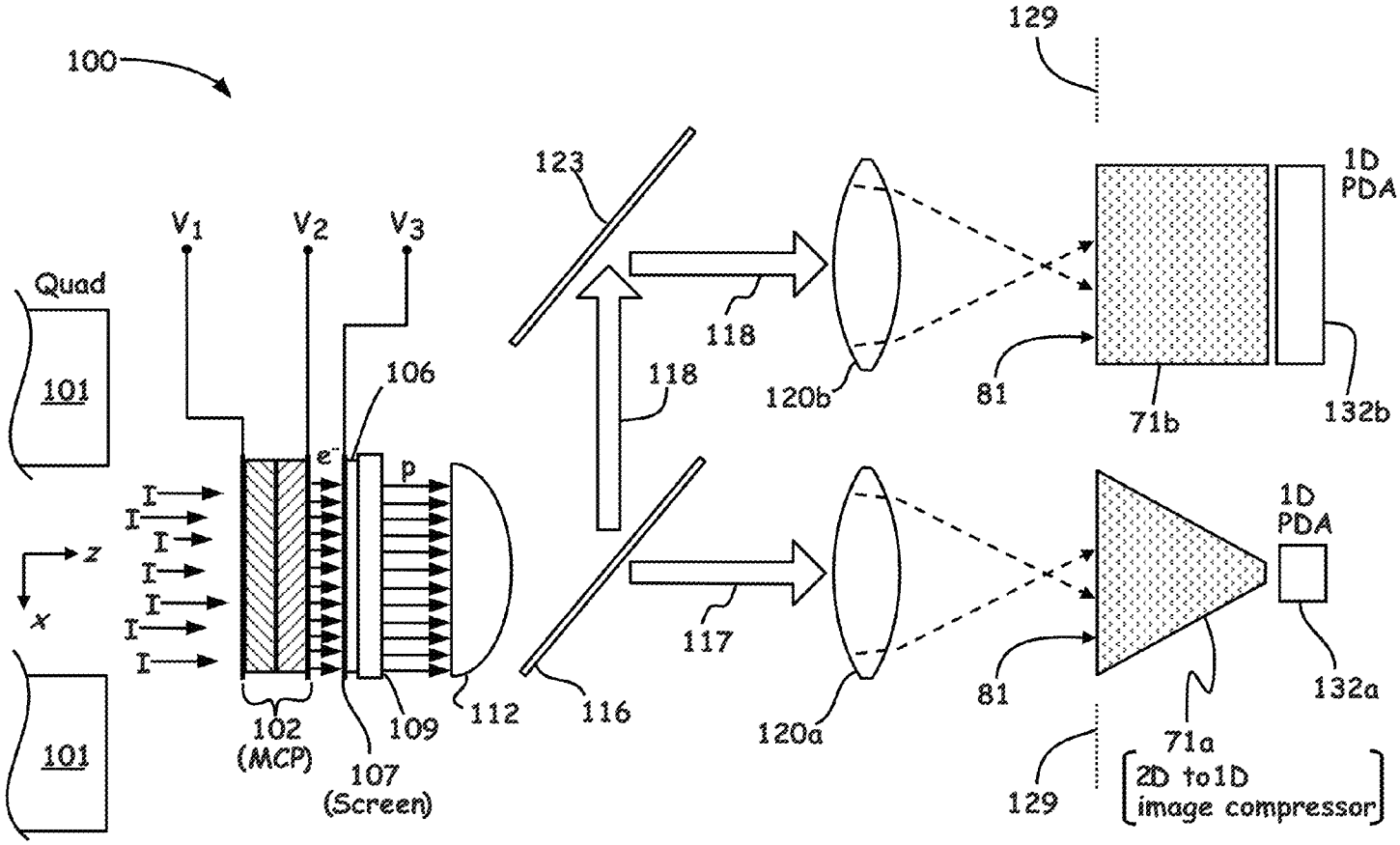
FIG. 2A is a schematic depiction of an embodiment of a time and position ion detector system in accordance with the present teachings that employs two linear photo-detector arrays.

FIG. 2A schematically depicts a first embodiment of a time and position ion detector system in accordance with the present teachings, which is shown generally as detector system 100. The ions I exiting from an ion occupation between quadrupole rod electrodes 101 are converted to electrons and the electron current is amplified by microchannel plate assembly or stack 102 comprising one or a plurality of microchannel plates as previously described with reference to FIG. 1C. It is preferable to generate photons, within the system 100, using a substrate plate 109 comprising a single-piece or integral component (such as a plate of glass, mica or plastic) that is coated with a transparent material, such as indium tin oxide, comprising a biasing electrode 106 and further coated with a phosphor material comprising a phosphorescent screen 107. A phosphor-coated plate comprising a bundle of fibers (such as plate 15 employed in the system 20 illustrated in FIG. 1C) may alternatively be employed as the substrate plate 109. Voltages $V_1$ and $V_2$ are applied to electrodes at opposite ends of the MCP stack 102 so as to draw ions I onto the stack and to accelerate generated electrons (denoted as e) through the stack. A voltage $V_3$ is applied to the transparent electrode 106 to draw the electrons onto the phosphorescent screen 107 at which photons (denoted as p) are generated.

Components shown on the right hand side of the substrate plate 109 in FIG. 2A serve to replace the two-dimensional camera 25 that is depicted in FIG. 1C. The replacement components comprise two separate linear photo-detector arrays 132*a*, 132*b* and associated optics. In operation, the phosphorescent screen 107 radiantly "glows" with a spatially-non-uniform intensity as it is impacted by electrons $e^-$ that are generated as a result of impingement of ions I onto the microchannel plate assembly or stack 102. The pattern of this spatially-non-uniform glow at any time corresponds to the spatial distribution of the number of ions emitted from between the quadrupole rods 101 at such time. Lenses 112 and 120*a* serve to transfer an image of the glowing phosphorescent screen onto an entrance face 81 of a novel image compressor 71*a* (described in greater detail below) Likewise, the pair of lenses 112 and 120*b* serve to transfer a duplicate image of the glowing phosphorescent screen onto an entrance face 81 of a second image compressor 71*b*. Light comprising photons that are generated by the phosphorescent screen 107 and that pass through the substrate plate 109 is collected and partially collimated into a light beam by a light collection lens 112. The partially collimated light beam is then split into two light-beam portions along two respective pathways by a beam splitter 116. A first such pathway—traversed by a first light beam portion—is indicated in FIG. 2A by arrows 117 and a second such pathway—traversed by the second light beam portion—is indicated by arrows 118. These light beam portions thus transfer two copies of the image information. Each of these light beam portions may then comprise about half the intensity of the original light source. Alternatively, the beam splitter 116 may be configured such that the ratio between the intensities of the transmitted and reflected light beam portions is other than one-to-one (1:1), such as, for example, nine-to-one (9:1), four-to-one (4:1), one-to-four (1:4), one-to-nine (1:9), etc. Such beam splitters are commercially available as either off-the-shelf stock items or can be custom fabricated in almost any desired transmitted-to-reflected ratio. A beam splitter in which the transmitted-to-reflected ratio is other than 1:1 may be employed, for example, to deliver a greater proportion of the light beam intensity to a detector having less sensitivity or to deliver a lesser proportion to a detector which might be easily saturated.

Each of the two light beam portions is refracted by a respective lens or lens system 120*a*, 120*b* so as to project a two-dimensional image of the phosphor screen onto a face of a respective image compressor device 71*a*, 71*b* (discussed in greater detail below). Two such image planes are depicted as image planes 129 in FIG. 2A. Each image compressor device 71*a*, 71*b* compresses the projected two-dimensional image into a line that is focused onto a respective linear (one-dimensional or "1-D") photo-detector array (PDA) 132*a*, 132*b*. Optionally, a reflecting device 123 comprising, such as a flat mirror or a prism, may be employed within one of the beam pathways to cause both beams to be parallel. The deflection of one of the beams by the reflecting device 123 may be used to decrease the size of the system 100 or possibly to facilitate mechanical mounting of the two photo-detector arrays 132*a*, 132*b* to a common circuit board and drive electronics.

According to the configuration illustrated in FIG. 2A, the two-dimensional image of phosphorescent screen that is projected onto the image compressor device 71*a* is compressed within the x-dimension by the compressor device 71*a* so as to be focused to a line (a line parallel to the y-dimension, perpendicular to the plane of the drawing of FIG. 2A) that is coincident with the position of a first linear photo-detector array 132*a*. Similarly, the two-dimensional image of the phosphorescent screen that is projected onto the image compressor device 71*b* is compressed within the y-dimension by the compressor device 71*b* so as to be focused to a line that is parallel to the x-dimension and that is coincident with the position of a second linear photo-detector array 132*b*. The first and second linear photo-detector arrays 132*a*, 132*b* may comprise, without limitation, two line cameras. The lenses may 120*a*, 120*b* comprise spherical or aspherical lenses or may comprise any lens systems capable of image projection. Although drawn differently in FIG. 2A, the first and second beam or image compressors 71*a*, 71*b* are considered to be identical. Also, the first and second photo-detector arrays 132*a*, 132*b* are considered to be identical. The illustrated difference in shape between the first and second image compressors 71*a*, 71*b* as well as the illustrated difference in shape between the first and second photo-detector arrays 132*a*, 132*b*, are employed so as to indicate that the second set of components is rotated about an axis within the plane of the drawing so as to be orthogonal to the first set.

Figure 2B:
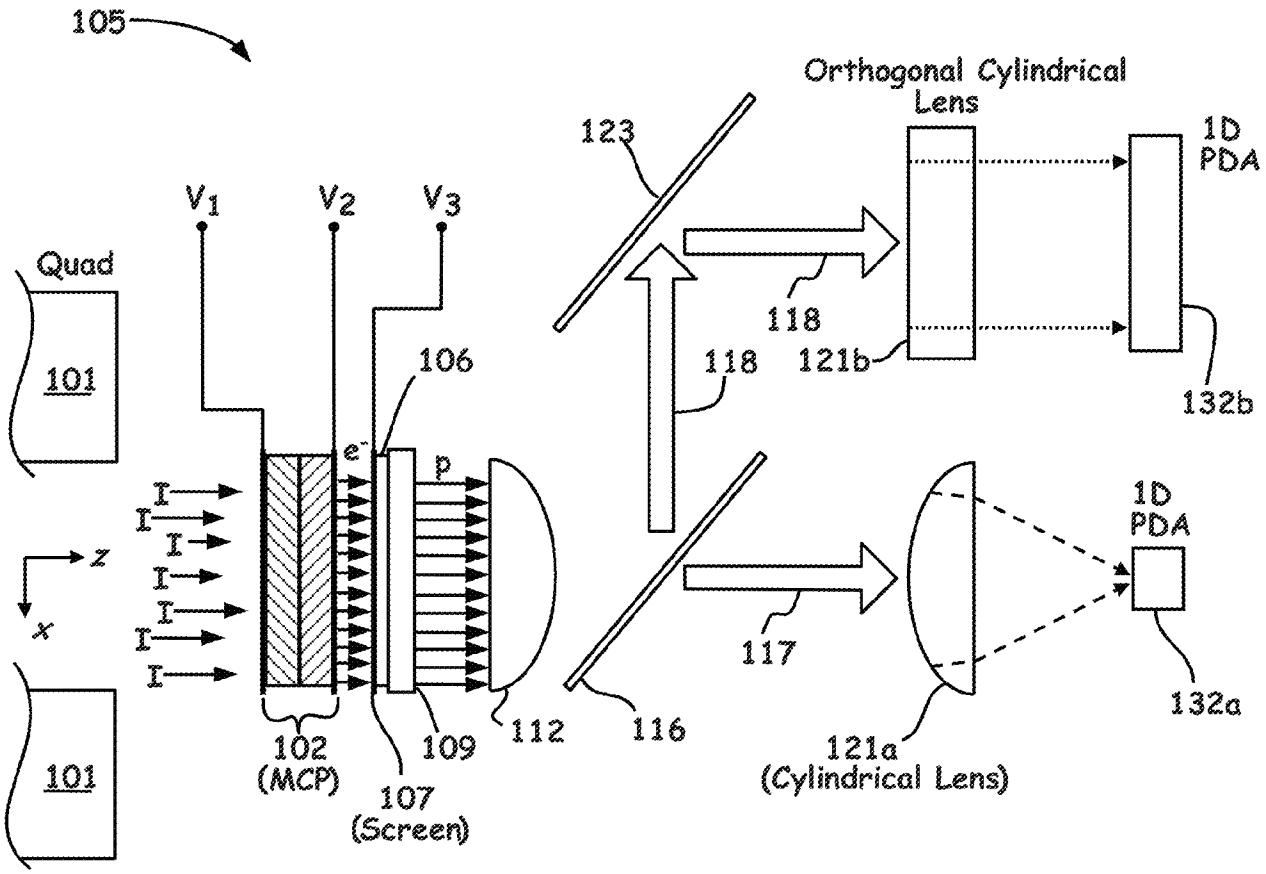
FIG. 2B is a schematic depiction of a second embodiment of a time and position ion detector system in accordance with the present teachings that employs two linear photo-detector arrays.

FIG. 2B illustrates another ion detector system which is a modified version of the ion detector system shown in FIG. 2A. In the system 105 of FIG. 2B, the previously described lenses or lens systems 120*a*, 120*b* and the image compressors 71*a*, 71*b* are replaced by first and second cylindrical lenses 121*a*, 121*b*. In the example shown, the two cylindrical lenses 121*a*, 121*b* are considered to be (but are not necessarily) identical. The illustrated difference in shape between the first and second cylindrical lenses 121*a*, 121*b* is employed so as to indicate that the second cylindrical lens is rotated about an axis within the plane of the drawing so as to be orthogonal to the first cylindrical lens. In the system 105, the light-sensitive regions of the photo-detector arrays 132*a*, 132*b* are disposed at the foci of the cylindrical lenses 121*a*, 121*b* such that each of the light beam portions 117, 118 is focused to a line on the light sensitive region of the respective photo-detector array 132*a*, 132*b*.

Figure 1A:
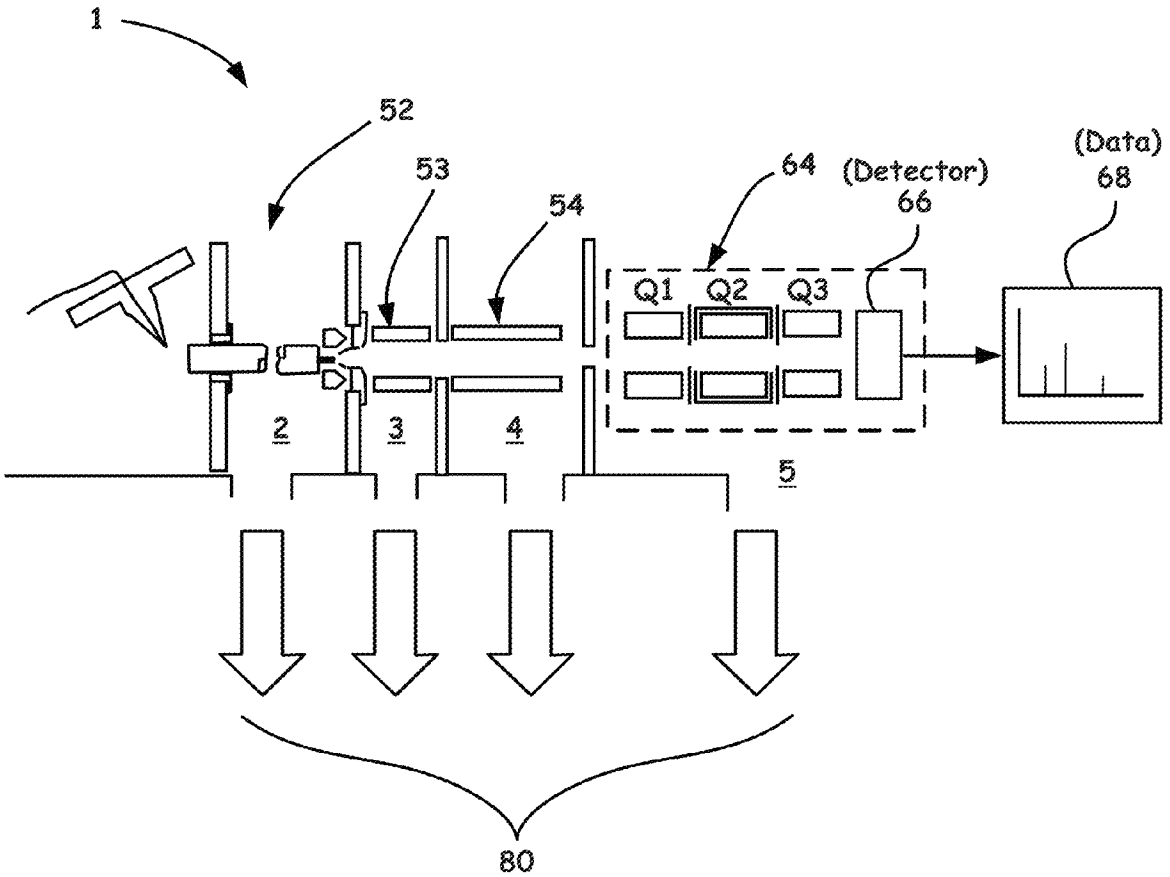
FIG. 1A (Prior Art)
FIG. 1A is a schematic example configuration of a triple stage mass spectrometer system.
Figure 1B:
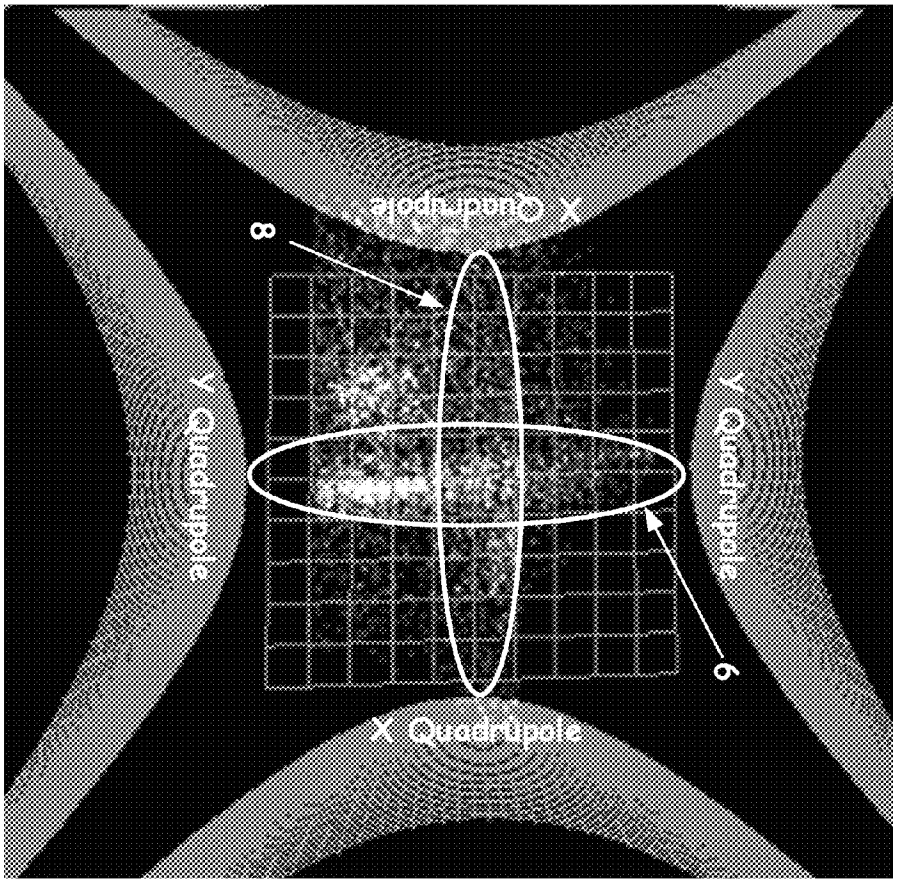
FIG. 1B (Prior Art)
FIG. 1B is a simulated recorded image of a multiple distinct species of ions as collected at the exit aperture of a quadrupole at a particular instant in time.
Figure 5:
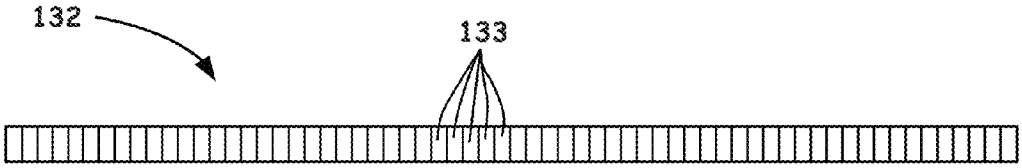
FIG. 5 is a schematic illustration of a photo-detector array.

FIG. 5 is a schematic depiction of light receiving face of a general photo-detector array 132. The array comprises a plurality of individual, independent light-sensitive elements 133, which may be referred to as "pixels". In the system 100 illustrated in FIG. 2A (as well as in other system embodiments taught herein), an instance of the array 132 may be interfaced to either a cylindrical lens 120*a*, 120*b*; a beam or image compressor 71*a*, 71*b*; or, a combination of a cylindrical lens and a beam/image compressor, as shown, with the linearly disposed plurality of pixels oriented so as to be coincident with a line focus produced by the cylindrical lens, beam/image compressor of lens-compressor combination.

As illustrated in FIG. 2A, each linear photo-detector array retains image variation along the dimension parallel to the array and sums (or "bins") image information orthogonal to the array. Because two mutually orthogonal arrays are employed, image variation parallel to both the x-direction and the y-direction (as defined above for quadrupole apparatuses) is retained. Binning the information is a very useful method of data compression without losing much information. As referred to in the aforementioned U.S. Pat. No. 8,389,929, this binning data compression can be implemented on a single, square imager with each photo-site having two outputs; one going to an x bin and one to a y bin as explained in detail in U.S. Pat. No. 8,829,409 in the name of inventor Wadsworth. For the case in which 64 bins are employed in each dimension, the full number of photo-sites with dual outputs is 64×64=4096. The alternative method depicted in FIG. 2A employs optics to enable the use of two separate, simpler, photo-detector arrays, such as line cameras, to provide the same orthogonal information as the previously-described two-dimensional camera.

Assuming each linear photo-detector array comprises 64 pixels, the configuration illustrated in FIG. 2A reduces the number of photo-sites needed for ion spatial and temporal imaging from 4096 pixels to 64+64=128 pixels. Such a configuration provides multiple benefits for cost since there is much less silicon used for a pair of line cameras compared to a single monolithic two-dimensional camera. Furthermore, in the case of a single or dual line camera, it is possible to orient all of the non-photo-sensitive electronics off to the side on an area of silicon not used for detecting photons. This allows line cameras to routinely have near 100% fill factor, (i.e., the amount of active photo area over the region that will be illuminated). Another important benefit is that the fabrication of relatively high speed line cameras is well known and line cameras that operate between 56 kHz and 140 kHz with resolutions of 1024 pixels or greater are commercially available. Despite the availability of commercially available line cameras, it is still desirable to produce a custom IC chip specifically designed for ion spatial and temporal imaging. Such a line camera may preferably include sub-RF cycle specificity and a microchannel analyzer per pixel, thereby allowing for substantially greater information content when using this detector design in the specific quadrupole mass analyzer imaging system. Additionally, custom linear arrays of sensors may be readily employed, such as photo diode arrays or arrays of silicon photomultipliers.

Figure 4A:
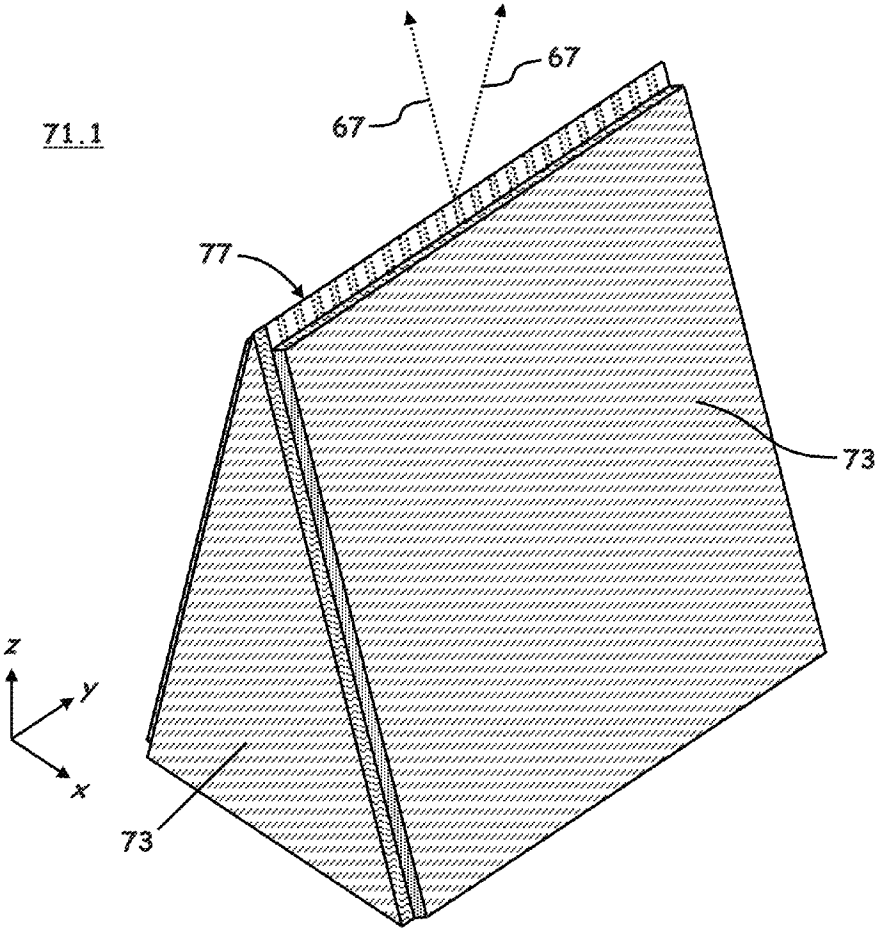
FIG. 4A is a schematic depiction of a two-dimensional to one-dimensional optical compressor device as may be employed in conjunction with various embodiments in accordance with the present teachings.
Figure 4B:
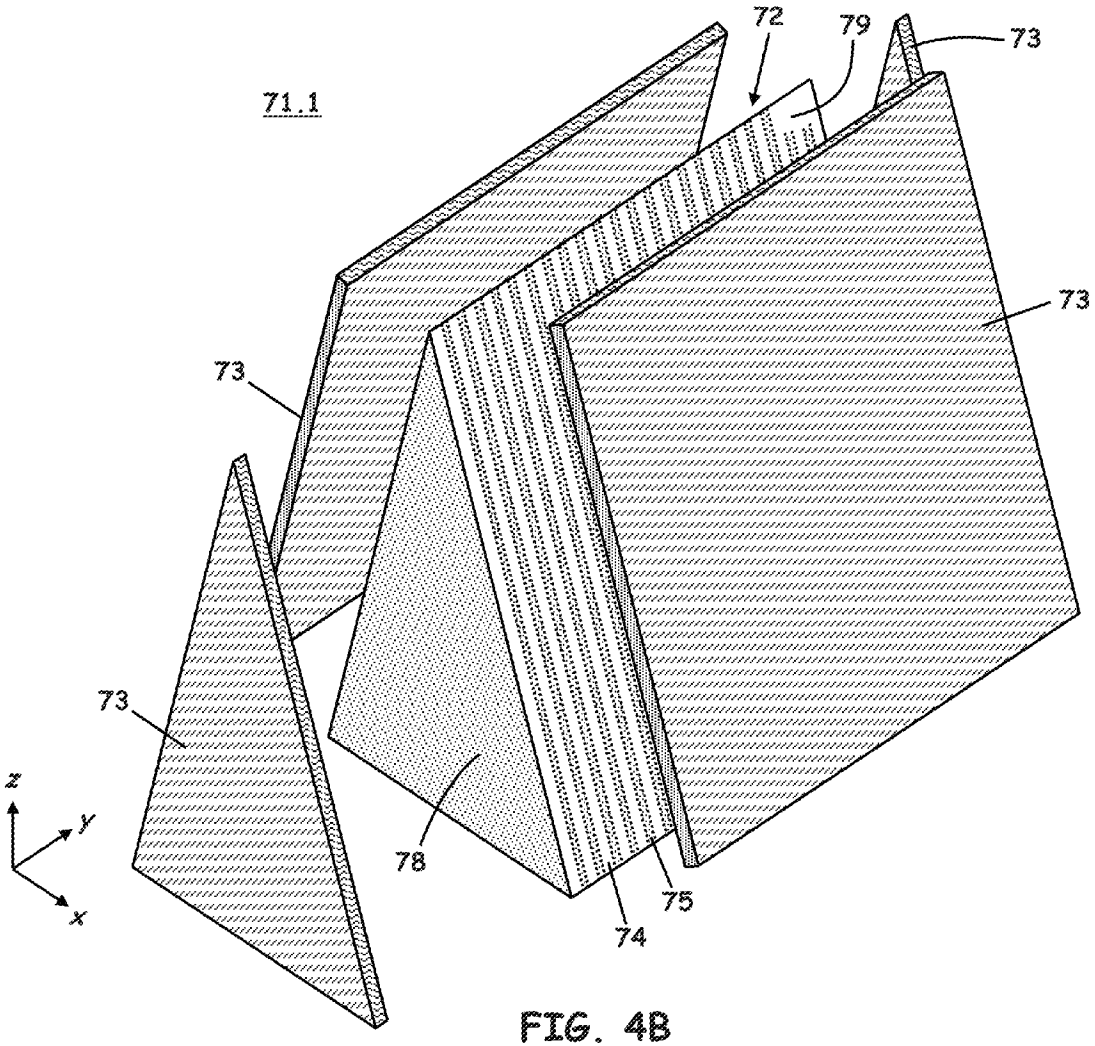
FIG. 4B is an exploded view of the two-dimensional to one-dimensional optical compressor device illustrated in FIG. 4A.
Figure 4C:
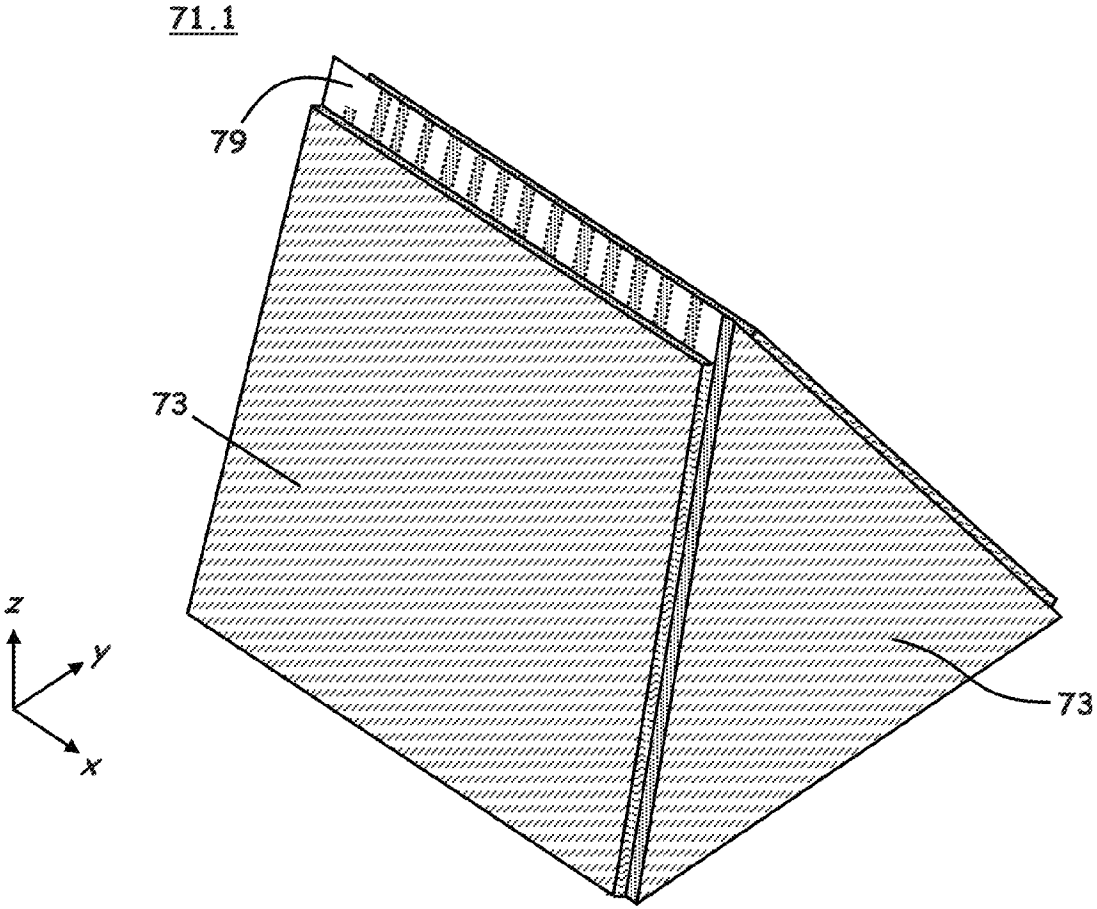
FIG. 4C is another view of the two-dimensional to one-dimensional optical compressor device illustrated in FIG. 4A, as disposed in an alternative orientation.
Figure 4D:
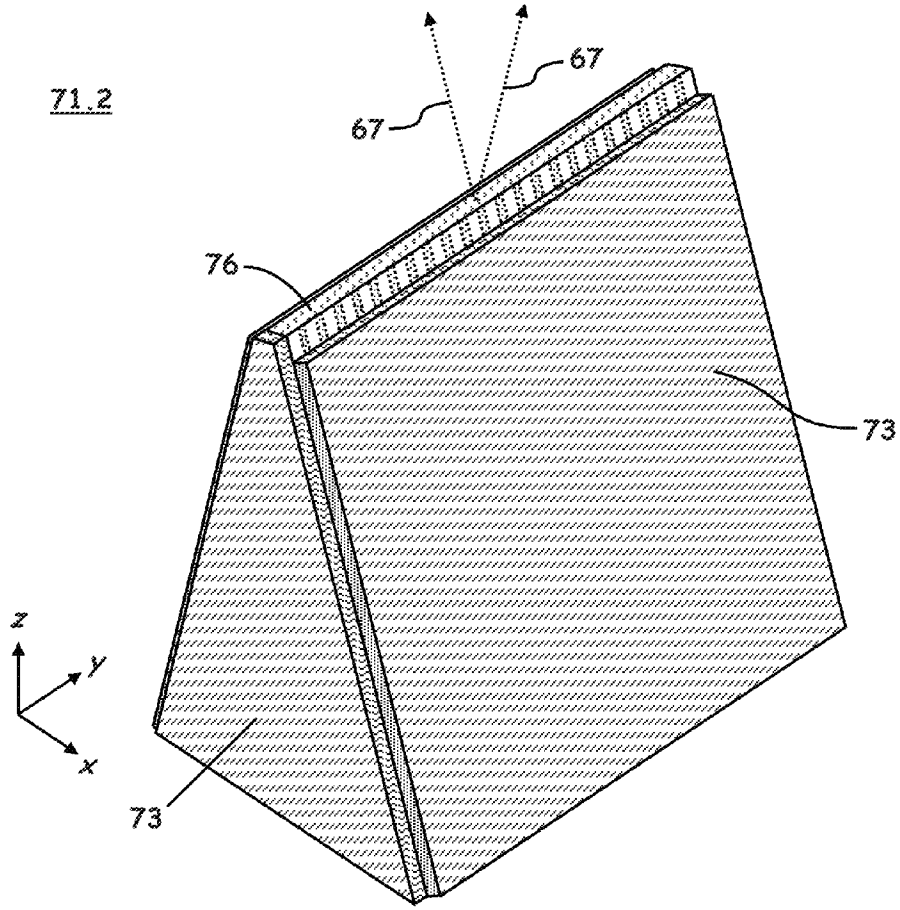
FIG. 4D is a schematic depiction of a second two-dimensional to one-dimensional optical compressor device.

FIGS. 4A-4C illustrate a specific example of a beam or image compressor device as may be employed in embodiments in accordance with the present teachings. FIG. 4D illustrates a second example of a beam or image compressor device that is a variation of the device shown in FIGS. 4A-4C. Such devices are described in greater detail in a co-pending United States Patent application titled "Optical Compression Device", and application Ser. No. 14/561,158, which is filed on even date herewith and is assigned to the assignee of this application and which is incorporated by reference herein in its entirety. In accordance with the illustrated example, the compressor device 71.1 (FIGS. 4A-4C) comprises a triangular prismatic optical compression device having a triangular prism base 78 and three rectangular side faces 79. The alternative device 71.2 illustrated in FIG. 4D is formed as a truncated triangular prismatic device one in which one of the edges between side faces 79 of the device 71.1 is replaced by an additional face 76. Either of the devices 71.1-71.2 may be used to flatten a light beam having a 2D cross-section to form a beam having a substantially 1D cross section (this beam flattening operation is sometimes referred to herein as "2D to 1D light compression").

FIGS. 4A-4D illustrate the compressor devices 71.1-71.2 oriented with regard to a Cartesian coordinate system, in which the x-, y- and z-axes correspond to the x-, y- and z-dimensions as defined above for a quadrupole apparatus. The term "correspond to" in the above sentence means that the x-, and y-axes defined for the compressor 71.1-71.2 are parallel to the projected images (as possibly reflected or rotated by various optical components) of the x- and y-dimensions of the associated quadrupole device and that the z-axis defined for the compressor is the direction of light propagation through the compressor. Thus, one rectangular side face of the prismatic compressor device is parallel to the x-y plane and is a light entrance face. FIG. 4A and FIG. 4C provide two views of the compressor device 71.1 in two different orientations. In the orientation of FIG. 4A, the linear edge 77 is parallel to the y-axis, whereas, in the orientation shown in FIG. 4C, the linear edge 77 is parallel to the x-axis. These different orientations generally correspond to the different orientations indicated for image compressor 71*a* and image compressor 71*b*, respectively, in FIG. 2A. (However, note that the image compressors 71*a* and 71*b* are shown in FIG. 2A in the truncated prismatic form, as in FIG. 4D.) The entrance face is not visible (i.e., is hidden) in FIGS. 4A-4D; however, entrance faces 81 of the image compressors 71*a*, 71*b* are noted in FIG. 2A. The light propagates through the device 71.1 or 71.2 and exits at a linear edge 77 (in the device 71.1) or at the exit face 76 (in the device 71.2) along exit trajectories 67. The light entrance and light exit faces may be referred to as "light gating faces". Some or all of the non-light-gating faces of the compressor device 71 are coated by internally light reflecting coatings 73 in order to minimize any loss of scattered or internally reflected light from within each waveguide of the device.

FIG. 4B provides an exploded view of the device 71.1 in which the reflective coatings 73 are shown detached from a core section 72. The coatings are applied onto at least the two side faces 79 that are parallel to the y-axis and that intersect at the edge 77 and, optionally, also to the two basal faces 78. As shown in FIG. 4B, the core section 72 of the compressor device 71 may be constructed from a plurality of generally planar waveguide layers 74 formed of a light transmissive polymer or glass or glass-like material and arranged in a stacked relationship to each other having a width that tapers from the light entrance face (i.e., the rectangular base) to the light exit face 77. Such tapering could be essentially linear or could exhibit a curved convex or concave tapering progression from the light entrance face of the device to the light exit face of the device. Such tapering can also be in the form of a parabolic concentrator in one dimension.

Each waveguide 74 of the compressor device 71 may be optically coupled to a single pixel 133 of a photo-detector array 132 (see FIG. 5). To prevent significant scrambling of linear data, it is desirable that light entering any particular waveguide should exit from the same waveguide at its light exit face wherein light cross over to an adjacent waveguide or the loss of light from either of the side faces is minimized. There are a number of ways to approach this problem; a second layer 75 may be disposed between adjacent waveguides 74 that minimizes light cross-talk by having an appropriate refractive index between the waveguide and the second interposed light refracting layer that prevents light escaping from the waveguide. Alternatively, waveguides may be used that have been modified to restrict light passage from their top and bottom surfaces. Multiple types of waveguides could be used, for example, in an ABABAB type repeating pattern where light cross-talk between the layers is inherently minimized due to differences in their refractive indices.

Figure 3A:
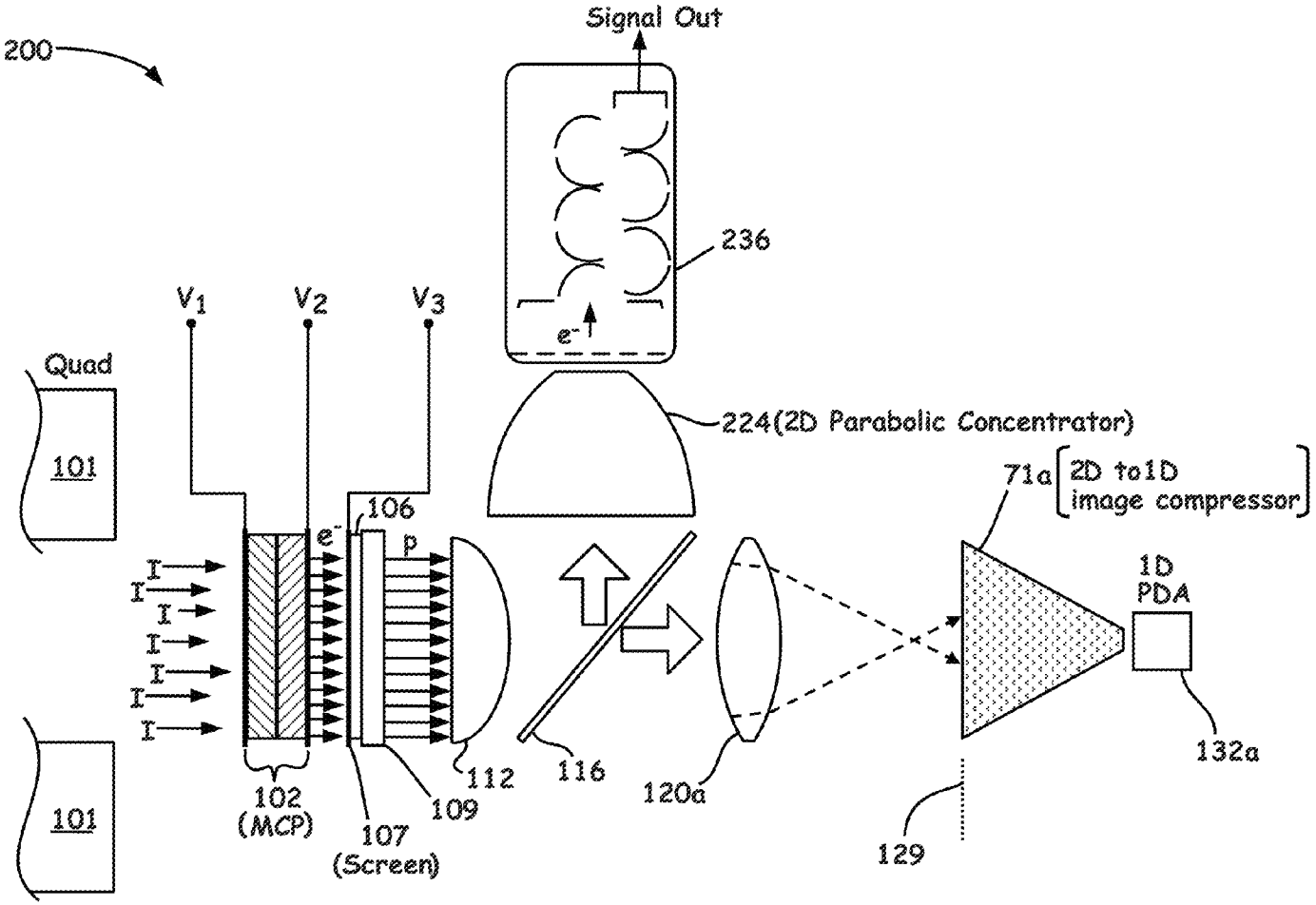
FIG. 3A is a schematic depiction of a first embodiment of a time and position ion detector system in accordance with the present teachings that employs a single linear photo-detector array and a non-imaging detector.

FIG. 3A is a schematic depiction of a time and position ion detector system in accordance with the present teachings that employs a single linear photo-detector array and a non-imaging detector. The system 200 depicted in FIG. 3A comprises many of the same components previously described with reference to FIG. 2A and numbered similarly to identical components shown in FIG. 2A. The system 200 differs from the system 100 in that one of the linear photo-detector arrays and its associated focusing optics (cylindrical lens or image compressor or both) is removed and is replaced with a conventional high-bandwidth non-imaging light detector, such as a photo-multiplier tube 236 as shown. The configuration of the detector system 200 enables spatial-temporal imaging detection in addition to conventional (non-imaging) detection.

In the system 200, the beam splitter 116 divides a light beam generated at the phosphor-coated screen 107 into first and second light beam portions, as previously described with reference to the system 100 depicted in FIG. 2A. Also, as previously described, the first light beam portion exits from the beam splitter 116 in the direction of photo-detector array 132*a* and is focused onto the photo-detector array by light focusing optics. The focusing optics in the path of the first light beam portion may include a focusing lens or lens assembly 120*a* and image compressor 71*a* as shown, or, alternatively, may comprise a cylindrical lens disposed such that its focus occurs essentially at the light-sensitive region of the PDA 132*a*, similar to the configuration shown in FIG. 2B. The second light beam portion is directed from beam splitter to the photo-multiplier tube. Preferably, the second light beam is concentrated onto the internal phosphor screen of the photo-multiplier tube by a two-dimensional parabolic concentrator device 224, which is well known in the art. A lens could be used in place of the parabolic concentrator.

The beam splitter may, in some embodiments, divide the light into roughly first and second light beam portions of approximately equal intensity. However, the intensities of the first and second light beam portions may, in other embodiments, be configured to be unequal. For example, if the two detection systems are found to have unequal gain or sensitivity, then the beam splitter may be configured to direct a greater proportion of the light beam to the less-sensitive detector. Also, although the photo-multiplier tube is shown as receiving a reflected light beam portion from the beam splitter 116 in FIG. 3A, the positions of the two detectors (and their associated optics) could be interchanged from the positions shown such that the photo-detector array 132*a* receives the reflected light beam portion.

Although a photomultiplier tube 236 is shown as a non-imaging detector in FIG. 3A, other photo-detector types, such as photodiode or photo transistor based detectors or a silicon-based photomultiplier, may alternatively be used. As is known in the art, photomultiplier tubes employ a series of dynodes which operate, electrically, very similarly to the dynode series of electron multiplier detectors, which are employed in many conventional mass spectrometer systems. Thus, the use of the photomultiplier tube 236 as the second detector can advantageously facilitate the use of existing mass spectrometer current-detection circuitry with little or no modification. This would allow a mass spectrometer having the detector system 200, when used in non-imaging detection mode, to exhibit performance and features (such as pulse counting) that are similar to those of existing electron multiplier based mass spectrometer systems, while also adding image detection capability.

Some ion cloud imaging information may be lost in the system 200, relative to the system 100 (FIG. 2A) or the system 105 (FIG. 2B), as a result of the elimination of the second photo-detector array. Nonetheless, a sufficient quantity of time and position data may be obtained, in many circumstances, by only employing the single one-dimensional photo detector array 132*a*. The detector array 132*a* in the system 200 may be configured to detect ion cloud density variation in either the x-direction or the y-direction.

Figure 3B:
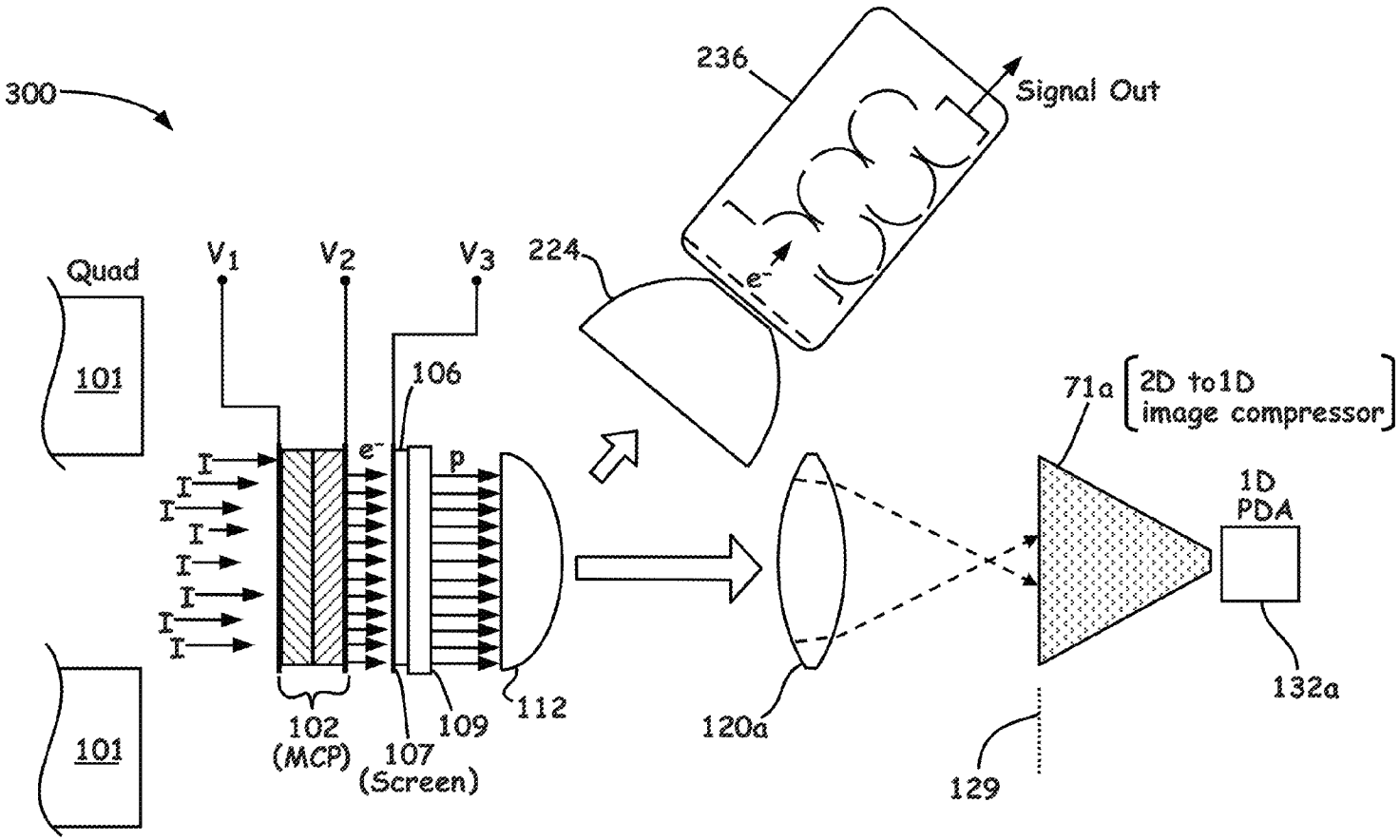
FIG. 3B is a schematic depiction of a second embodiment of a time and position ion detector system in accordance with the present teachings that employs a single linear photo-detector array and a non-imaging detector.

FIG. 3B schematically depicts another time and position ion detector system in accordance with the present teachings. The system 300 shown in FIG. 3B represents a variation of the system 200 in which the beam splitter is eliminated and the second, non-imaging detector (e.g., photo-multiplier tube 236, as shown) is simply aimed in the general direction of the phosphor coated substrate plate 109 and light collection lens system 112 so as to collect photons that are scattered from lens and plate surfaces. The inventors have determined that the configuration shown in FIG. 3B not only increases the intensity of light directed to the photo-detector array 132*a* but also does not seriously degrade the signal since the intensity of scattered light is sufficient to be detected by a detector having high light sensitivity, such as a photomultiplier system. The focusing optics in the path of the main light beam portion may include a focusing lens or lens assembly 120*a* and image compressor 71*a* as shown, or, alternatively, may comprise a cylindrical lens disposed such that its focus occurs essentially at the light-sensitive region of the PDA 132*a*, similar to the configuration shown in FIG. 2B.

Figure 3C:
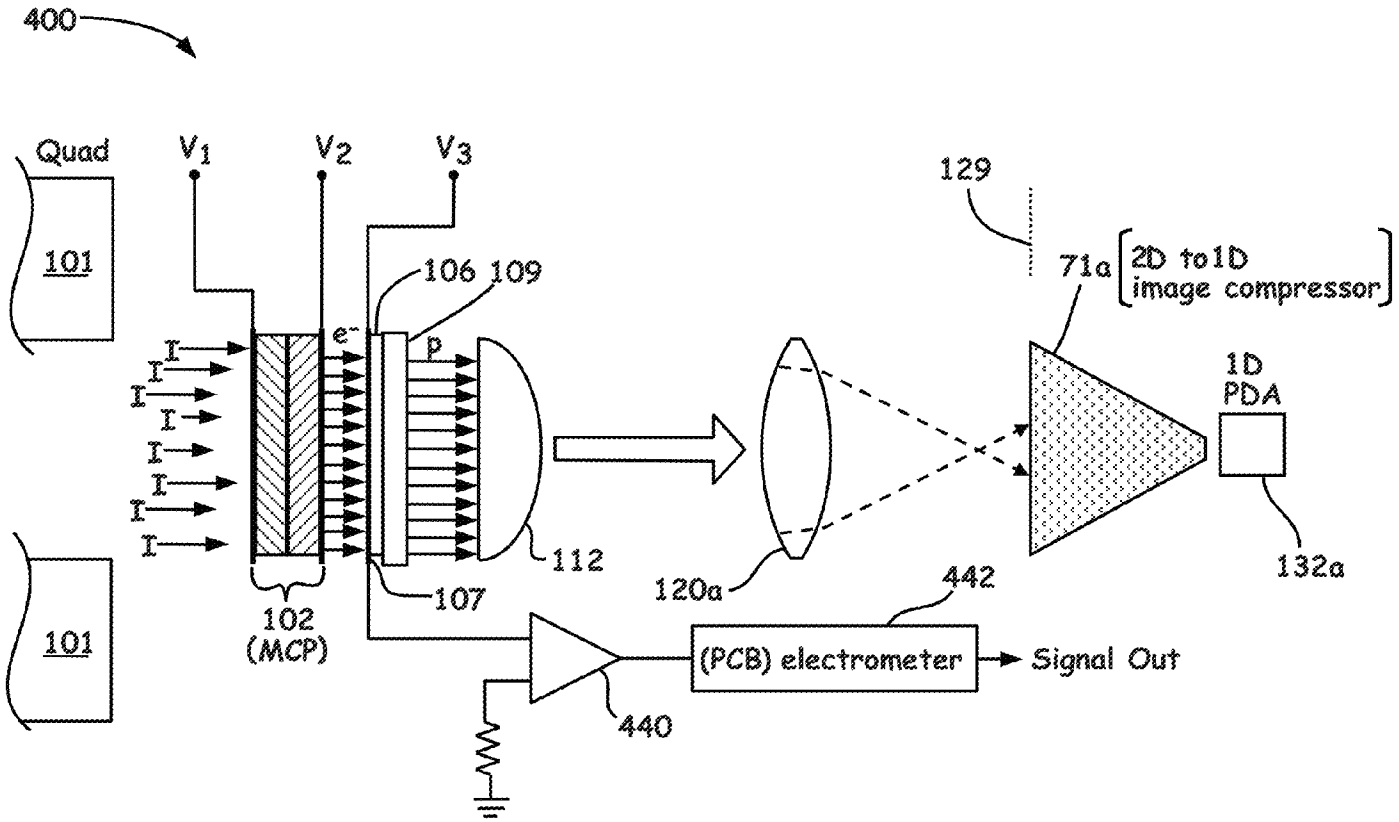
FIG. 3C is a schematic depiction of a third embodiment of a time and position ion detector system in accordance with the present teachings that employs a single linear photo-detector array and a one-dimensional detector.

FIG. 3C schematically depicts another time and position ion detector system, in accordance with the present teachings, that employs both an imaging detector (photo-detector array 132*a*) in addition to a non-imaging detector. The non-imaging detector of the system 400 shown in FIG. 3C is an electrometer which measures the image current that is collected on the phosphor screen 107. The electrons that impinge upon the electrode $V_3$ are directed to an amplifier (shown as differential amplifier 440) and the amplified signal is directed to the electrometer 442. A capacitor could optionally be included between the electrode $V_3$ and the amplifier 440 to facilitate pulse counting. Although only a single photo-detector array 132*a* is illustrated in FIG. 3C, a second photodetector array could be added (for example, according to the configuration shown in FIG. 2A) if adequate space is available. The focusing optics in the path of the main light beam portion may include a focusing lens or lens assembly 120*a* and image compressor 71*a* as shown, or, alternatively, may comprise a cylindrical lens disposed such that its focus occurs essentially at the light-sensitive region of the PDA 132*a*, similar to the configuration shown in FIG. 2B.

In the case of embodiments that employ a linear array of photodetectors, an image of a phosphor-bearing surface must be compressed into a line, the compression being along a dimension that is orthogonal to the length of the array. However, depending on the relative sizes of the phosphor screen and the detector, it may be necessary to either compress or magnify the image along a direction parallel to the linear array. (Note that the dimensions of a phosphor screen, as used herein, will generally be approximately equivalent to the dimensions of a mass analyzer from which ions are emitted.) Conventional line cameras based on charge-coupled-device (CCD) technology generally comprise approximately two-thousand pixels where each such pixel is approximately 10-20 μm in size. When such line cameras are employed, for instance, to detect phosphorescence generated from ions emitted from a quadrupole device having dimensions of 12 mm×12 mm, essentially no magnification or compression is required parallel to the length of the photo-detector array.

Figure 6A:
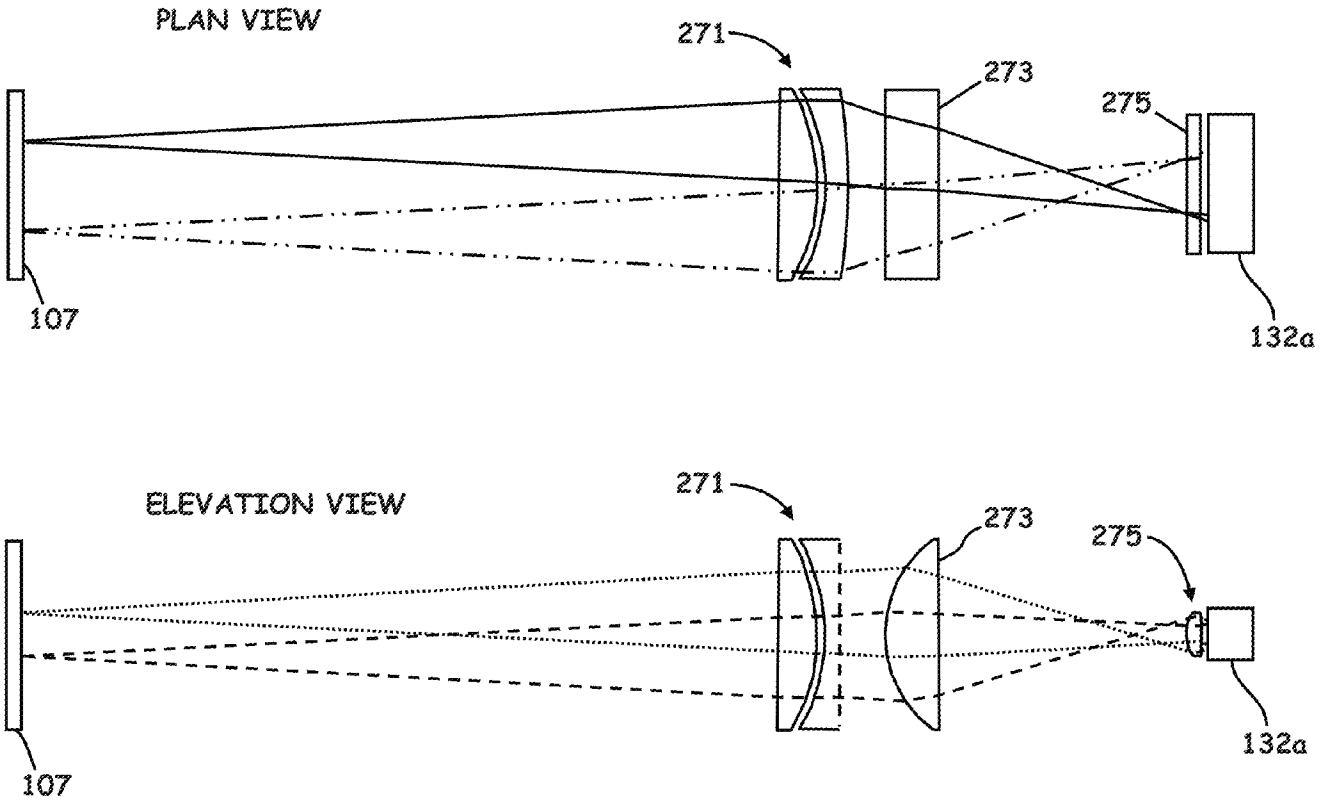
FIG. 6A is a schematic depiction of an optics sub-system that may be employed in various embodiments of a time and position ion detector system in accordance with the present teachings, wherein an image of a phosphor screen is strongly compressed parallel to one dimension and less strongly compressed or uncompressed parallel to a second, orthogonal dimension.

In light of the above considerations, simple optical configurations employing a cylindrical lens such as shown in FIG. 2B work well under conditions in which little or no image compression is required along a direction parallel to the photo-detector array. FIG. 6A shows a slightly more complex version of an optical system which may be employed to transfer light from a phosphorescent screen 107 onto a photo-detector array 132*a* with improved spatial resolution. As previously described with reference to FIG. 2B, a cylindrical lens 273 is employed to focus light emanating from phosphorescent screen 107 to a line. Additionally, a smaller cylindrical lens 275, having a long axis (cylindrical axis) parallel to the long axis of the cylindrical lens 273, is employed to provide a small beam waist at the surface of the detector array 132*a*. A rod lens may be used in place of the small cylindrical lens 275, without significant loss of spatial resolution. Further, an image correcting doublet 271 comprising a plano-convex and a concavo-convex lens, is employed to preserve image resolution along the dimension parallel to the detector array.

The optics configuration shown in FIG. 6A may be used in a system employing only a single photo-detector array (cf., FIGS. 3A-3C) or in a system employing two photo-detector arrays (cf. FIGS. 2A-2B). In the latter instance, a beam splitter (not shown in FIG. 6A) may be employed between the phosphor screen 107 and the lens doublet 271 so as to split off a second light beam portion from the optical pathway shown in FIG. 6A. A second instance of the set of lens elements 271, 273 and 275 would then be disposed along the path of the second light beam portion.

Recently, a new type of line camera comprising an array of discrete silicon photomultipliers has become available. Such line cameras may be constructed, for example, from silicon photomultipliers provided commercially by SensL™ of Cork, Ireland. The pixels in such a line camera are significantly larger than those in line cameras employing CCD technology. For example, a sixty-four-element row of 1-mm active area SensL devices requires space between individual photo-detector sensors such that the center to center spacing is 1.7 mm. Thus, a sixty-four-element array of such devices requires an optics configuration that generates an image that is magnified to a size of over 100 mm in one dimension while being compressed to 1 mm in the orthogonal dimension.

Figure 6B:
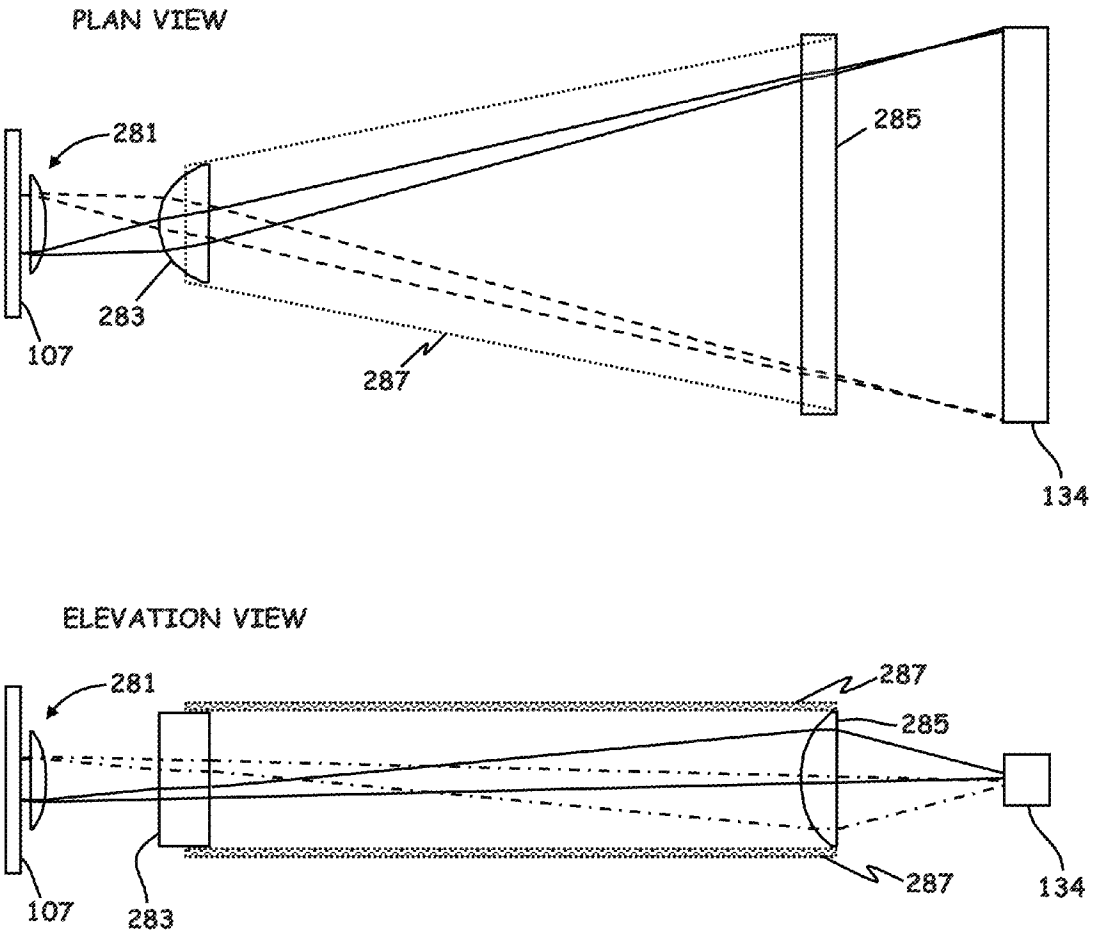
FIG. 6B is a schematic depiction of another optics sub-system that may be employed in various embodiments of a time and position ion detector system in accordance with the present teachings, wherein an image of a phosphor screen is strongly compressed parallel to one dimension and is magnified parallel to a second, orthogonal dimension.

FIG. 6B illustrates an optics configuration that may be employed under in a system in which a silicon photomultiplier array detector, as described above, is employed. The optics configuration shown in FIG. 6B comprises a first cylindrical lens 283 disposed with its long axis (cylindrical axis) orthogonal to the long dimension of the discrete silicon photomultiplier array 134 and several focal lengths distant from the silicon photomultiplier array 134. Taken together with a plano-convex lens 281 adjacent to the phosphor light source, the cylindrical lens 283 functions as an optical projector so as to project a image of the phosphor screen 107 that is magnified parallel to the length of line of pixels. The optics configuration of FIG. 6B further comprises a second cylindrical lens 285 having its long axis disposed orthogonal to the long axis of the first cylindrical lens, such that the image is compressed to a line along a dimension orthogonal to the line of pixels. The effective numerical aperture of the lens system of FIG. 6B may be increased by optionally incorporating mirrors 287 disposed "above" and "below" (in accordance with the elevation views) the lens system so as to capture additional light that may not be intercepted by the lens 285. Although planar mirrors are illustrated in FIG. 6B, concave mirrors (such as sections of parabolic mirrors) may be employed so the detector 134 may capture light that diverges at a range of angles.

The optics configuration shown in FIG. 6B may be used in a system employing only a single photo-detector array (cf., FIGS. 3A-3C) or in a system employing two photo-detector arrays (cf. FIGS. 2A-2B). In the latter instance, a beam splitter (not shown in FIG. 6B) may be employed between the phosphor screen 107 and the first cylindrical lens 283 so as to split off a second light beam portion from the optical pathway shown in FIG. 6B. A second instance of the set of lens elements 283 and 285 would then be disposed along the path of the second light beam portion.

One of ordinary skill in the optics arts would readily understand how to construct alternative optical systems for transforming a two-dimensional image (e.g., of a phosphor screen) into a focused or nearly focused line that is transferred onto a linear detector system. For example, U.S. Pat. No. 5,513,201, in the name of inventors Yamaguchi et al. and hereby incorporated by reference herein in its entirety, teaches a large number of image rotation designs that are relevant for transferring each one-dimensional compressed image to a linear sensor.

In the description of the invention herein, it is understood that a word appearing in the singular encompasses its plural counterpart, and a word appearing in the plural encompasses its singular counterpart, unless implicitly or explicitly understood or stated otherwise. Furthermore, it is understood that for any given component or embodiment described herein, any of the possible candidates or alternatives listed for that component may generally be used individually or in combination with one another, unless implicitly or explicitly understood or stated otherwise. Moreover, it is to be appreciated that the figures, as shown herein, are not necessarily drawn to scale, wherein some of the elements may be drawn merely for clarity of the invention. Also, reference numerals may be repeated among the various figures to show corresponding or analogous elements. Additionally, it will be understood that any list of such candidates or alternatives is merely illustrative, not limiting, unless implicitly or explicitly understood or stated otherwise. In addition, unless otherwise indicated, numbers expressing quantities of ingredients, constituents, reaction conditions and so forth used in the specification and claims are to be understood as being modified by the term "about."

The discussion included in this application is intended to serve as a basic description. The present invention is not to be limited in scope by the specific embodiments described herein, which are intended as single illustrations of individual aspects of the invention, and functionally equivalent methods and components are within the scope of the invention. For example, according to some embodiments, the electron-generating means, shown as microchannel plates (MCPs) in the drawings, may be replaced by a set of one or more metal channel dynodes. Each such metal channel dynode (MCD) may comprise a metal electrode plate having a plurality of perforations or channels therethrough. At the first MCD, ions emitted from the mass analyzer are neutralized by impact with the metal plate or with the interior walls of the perforations or channels and at least a portion of their kinetic energy is released as kinetic energy of ejected secondary electrons. Subsequent MCD plates of a stack of such plates may similarly further amplify the quantity of secondary electrons. If the metal channel dynodes are coated with an appropriate enhancer substance such as magnesium oxide or any other enhancer (generally, a metal oxide), the conversion efficiency should be as good as the input surface of an MCP. Indeed, various modifications of the invention, in addition to those shown and described herein will become apparent to those skilled in the art from the foregoing description and accompanying drawings. Such modifications are intended to fall within the scope of the appended claims. Any patents, patent applications, patent application publications or other literature mentioned herein are hereby incorporated by reference herein in their respective entirety as if fully set forth herein, except that, in the event of any conflict between the incorporated reference and the present specification, the language of the present specification will control.

What is claimed is:

1. An ion detection system for a detecting a quantity of ions exiting from a mass analyzer of a mass spectrometer, the ion detection system comprising:

(a) photon generating means configured to receive the quantity of ions and to generate a quantity of photons that is proportional to the quantity of ions;

(b) a light collection lens optically coupled to the photon generating means and configured to transmit a beam of the generated photons;

(c) line focusing means operable to focus at least a first portion of the beam to a line; and (d) a linear array of photo-detectors configured to detect a variation of the quantity of generated photons along the focused line.

2. An ion detection system as recited in claim 1, wherein the photon generating means comprises:

(a1) electron generating means configured to receive the quantity of ions and to generate a quantity of electrons that is proportional to the quantity of ions; and (a2) a phosphor screen disposed on a surface of a substrate and configured to receive the quantity of generated electrons and to generate the quantity of photons in proportion to the quantity of generated electrons.

3. An ion detection system as recited in claim 2, wherein the electron generating means comprises:

an assembly of one or more microchannel plates (MCPs), the assembly comprising a first end facing the mass analyzer and a second end facing the phosphor screen; and an electrode disposed at the first end and an electrode disposed at the second end of the assembly.

4. An ion detection system as recited in claim 2, wherein the electron generating means comprises:

an assembly of one or more metal channel dynodes, the assembly comprising a first end facing the mass analyzer and a second end facing the phosphor screen.

5. An ion detection system as recited in claim 1, wherein the line focusing means comprises a cylindrical lens.

6. An ion detection system as recited in claim 5, further comprising a beam compressor apparatus comprising:

a prismatic core section comprising:

a plurality of waveguide plates disposed in a stacked arrangement parallel to two prism basal faces;

an entrance face that receives the generated photons; and an exit face from which the generated photons are emitted, the core section comprising a taper from the entrance to the exit face; and a reflective coating disposed on at least one face of the prismatic core section other than the entrance and exit faces.

7. An ion detection system as recited in claim 1, wherein the line focusing means comprises:

a prismatic core section comprising:

a plurality of waveguide plates disposed in a stacked arrangement parallel to two prism basal faces;

a photon entrance face; and a photon exit face, the core section comprising a taper from the entrance to the exit face; and a reflective coating disposed on at least one face of the prismatic core section other than the entrance and exit faces.

8. An ion detection system as recited in claim 1, wherein the linear array of photo-detectors comprises a line camera.

9. An ion detection system as recited in claim 2, further comprising:

(e) an electrode in contact with the substrate and operable to collect the quantity of electrons received by the phosphor screen;

(f) an electrometer electrically coupled to the electrode and operable to detect the electrons collected by the electrode; and (g) an electronic amplifier electrically coupled between the electrode and the electrometer.

10. An ion detection system as recited in claim 1, further comprising:

(e) an additional photodetector optically coupled to the light collection lens so as to receive a second portion of the beam that is not focused by the line focusing means.

11. An ion detection system as recited in claim 10, wherein the additional photodetector comprises a photomultiplier tube.

12. An ion detection system as recited in claim 10, further comprising:

(f) an optical beam splitter configured to receive the beam and to divide the beam into the first and second portions.

13. An ion detection system as recited in claim 10, further comprising:

(f) a two-dimensional optical parabolic concentrator optically coupled between the light collection lens and the additional photodetector.

14. An ion detection system as recited in claim 1, further comprising:

(e) an additional photodetector disposed so as to receive light scattered from one or more of the phosphor screen, the substrate and the light collection lens.

15. An ion detection system as recited in claim 14, wherein the additional photodetector comprises a photomultiplier tube.

16. An ion detection system as recited in claim 14, further comprising:

(f) a two-dimensional optical parabolic concentrator optically coupled between the light collection lens and the additional photodetector.

17. An ion detection system as recited in claim 1, further comprising:

(f) an optical beam splitter configured to receive the beam from the light collection lens and to divide the beam into the first portion and into a second portion;

(g) second line focusing means operable to focus the second portion of the beam to a second line; and (h) a second linear array of photo-detectors configured to detect a variation of the quantity of generated photons along the second focused line, wherein the variation of the quantity of generated photons along the first focused line corresponds to variation of photon generation parallel to a first direction and the variation of the quantity of generated photons along the second focused line corresponds to variation of photon generation parallel to a second direction that is orthogonal to the first direction.

18. An ion detection system as recited in claim 17 wherein one of the first and second directions is parallel to a line connecting centers of a set of x-rods of the mass analyzer and the other of the first and second directions is parallel to a line connecting centers of a set of y-rods of the mass analyzer.

19. An ion detection system as recited in claim 17 wherein each of the line focusing means and the second line focusing means comprises a cylindrical lens.

20. An ion detection system as recited in claim 17 wherein each of the line focusing means and the second line focusing means comprises:

a prismatic core section comprising:

a plurality of waveguide plates disposed in a stacked arrangement parallel to two prism basal faces;

an entrance face that receives the generated photons; and an exit face from which the generated photons are emitted, the core section comprising a taper from the entrance to the exit face; and a reflective coating disposed on at least one face of the prismatic core section other than the entrance and exit faces.

21. A method of detecting a quantity of ions emitted from a mass analyzer of a mass spectrometer, comprising:

(i) generating a quantity of photons corresponding to the quantity of ions;

(ii) focusing a light beam comprising at least a first portion of the quantity of photons to a focused line; and (iii) detecting a variation of the at least a first portion of the quantity of generated photons along the focused line using a linear array of photodetectors, wherein the variation of the quantity of generated photons along the focused line corresponds to a variation of the quantity of ions emitted from the mass analyzer parallel to a first cross-section direction of the mass analyzer.

22. A method as recited in claim 21, further comprising:

(iv) focusing a second light beam comprising a second portion of the quantity of photons to a second focused line; and (v) detecting a variation of the second portion of the quantity of generated photons along the second focused line using a second linear array of photodetectors, wherein the variation of the second portion of the quantity of generated photons along the second focused line corresponds to a variation of the quantity of ions emitted from the mass analyzer parallel to a second cross-section direction of the mass analyzer, the second cross-section direction orthogonal to the first cross-section direction.

23. A method as recited in claim 21, further comprising:

(iv) detecting an intensity of a second portion of the quantity of generated photons using an additional photodetector.

24. A method as recited in claim 23, further comprising:

separating the first and second portions of the quantity of generated photons using a beam splitter.

25. A method as recited in claim 21, wherein the step (i) of generating the quantity of photons comprises:

generating a quantity of electrons corresponding to the quantity of ions; and generating the quantity of photons, wherein the generated quantity of photons corresponds to the generated quantity of electrons.

26. A method as recited in claim 24, further comprising:

measuring the quantity of generated electrons using an electrometer.

27. An ion detection system for a detecting a quantity of ions exiting from a mass analyzer of a mass spectrometer, the ion detection system comprising:

an assembly of one or more microchannel plates disposed at an ion exit end of the mass analyzer, the assembly having a front end disposed so as to receive the quantity of ions and a back end;

a first and a second electrode disposed at the front and back ends, respectively, of the assembly of microchannel plates;

a substrate plate comprising a front face disposed facing the microchannel plate assembly and a back face and having a phosphorescent material disposed on the front face;

a third electrode disposed in contact with the front face of the substrate plate;

a light collection lens optically coupled to the back face of the substrate plate;

a line focusing means optically coupled to the light collection lens;

a linear array of photo-detectors disposed at a focus of the line focusing means; and at least one voltage source electrically coupled to the first, second and third electrodes.

28. An ion detection system as recited in claim 27, further comprising an additional photodetector system optically coupled to the light collection lens.

29. An ion detection system as recited in claim 28, wherein the additional photodetector system comprises an additional linear array of photodetectors, and further comprising:

an optical beam splitter optically coupled between the light collection lens and the line focusing means; and a two-dimensional optical parabolic concentrator optically coupled between the light collection lens and the additional linear array of photodetectors, wherein the additional linear array of photodetectors is disposed at a focus of the second line focusing means.

30. An ion detection system as recited in claim 28, wherein the additional photodetector system comprises a photomultiplier tube.

31. An ion detection system as recited in claim 28, further comprising:

an optical beam splitter optically coupled between the light collection lens and the line focusing means; and a two-dimensional optical parabolic concentrator optically coupled between the optical beam splitter and the additional photodetector system.

32. An ion detection system as recited in claim 31, wherein the additional photodetector system comprises a photomultiplier tube.

33. An ion detection system as recited in claim 27, further comprising:

a fourth electrode disposed in contact with the front face of the substrate plate; and an electrometer electrically coupled to the fourth electrode.

* * * * *